US012298112B2

(12) United States Patent
Howard

(10) Patent No.: US 12,298,112 B2
(45) Date of Patent: May 13, 2025

(54) APPARATUS FOR GENERATING A VITALS TARGET

(71) Applicant: JMA Outdoors, Inc., Lafayette, CO (US)

(72) Inventor: David Gene Howard, Lafayette, CO (US)

(73) Assignee: JMA Outdoors, Inc., Lafayette, CO (US)

( * ) Notice: Subject to any disclaimer, the term of this patent is extended or adjusted under 35 U.S.C. 154(b) by 0 days.

(21) Appl. No.: 18/402,612

(22) Filed: Jan. 2, 2024

(65) Prior Publication Data

US 2024/0328759 A1 Oct. 3, 2024

Related U.S. Application Data

(63) Continuation of application No. 17/878,447, filed on Aug. 1, 2022, now Pat. No. 11,867,484, which is a continuation of application No. 16/983,447, filed on Aug. 3, 2020, now Pat. No. 11,415,396, which is a continuation of application No. 16/182,339, filed on Nov. 6, 2018, now Pat. No. 10,746,511.

(60) Provisional application No. 62/581,982, filed on Nov. 6, 2017.

(51) Int. Cl.
*F41J 1/00* (2006.01)
*F41J 9/14* (2006.01)

(52) U.S. Cl.
CPC .. *F41J 1/00* (2013.01); *F41J 9/14* (2013.01)

(58) Field of Classification Search
CPC ..... F41J 1/00; F41J 9/14
See application file for complete search history.

(56) References Cited

U.S. PATENT DOCUMENTS

| | | | |
|---|---|---|---|
| D14,355 | S | 10/1883 | Dressel |
| 738,790 | A | 9/1903 | Gaudet |
| D289,532 | S | 4/1987 | Ivie |
| D339,826 | S | 9/1993 | Alling et al. |

(Continued)

OTHER PUBLICATIONS

"Effective Range Targets" [online]. Ontario Out of Doors. Published on Jan. 22, 2019. Retrieved from the Internet: <https://www.youtube.com/watch?v=ngfW-_AAtjQ> 1 page.

(Continued)

*Primary Examiner* — David L Lewis
*Assistant Examiner* — Shauna-Kay Hall
(74) *Attorney, Agent, or Firm* — Perkins Coie LLP

(57) ABSTRACT

An apparatus for generating a vitals target may include a processor, an output device, and a non-transitory storage medium. The output device is communicatively connected to the processor. The non-transitory storage medium may include a number of module. The number of modules may include a target distance identify module, a target animal identify module, a vital zone determine module, a first distance identify module, and a target calculate module. The target distance identify module that identifies a target set distance for a target configuration. The target animal identify module identifies an animal being simulated. The first distance identify module identifying a first distance being simulated at the target set distance. The target calculate module rendering the vital zone for a target distance. The output generate module causing the output device to generate a vitals target.

21 Claims, 26 Drawing Sheets

(56) References Cited

U.S. PATENT DOCUMENTS

| | | | | |
|---|---|---|---|---|
| D342,302 | S | 12/1993 | Hanna | |
| D355,695 | S | 2/1995 | Moore | |
| D356,604 | S | 3/1995 | Miccio | |
| 5,415,415 | A | 5/1995 | Mujic | |
| D368,494 | S | 4/1996 | Schneider | |
| 5,613,686 | A | 3/1997 | Mu | |
| 5,649,706 | A | 7/1997 | Treat et al. | |
| D390,276 | S | 2/1998 | Huang | |
| D390,277 | S | 2/1998 | Yiu | |
| D390,278 | S | 2/1998 | Yiu | |
| 5,718,433 | A | 2/1998 | Lu et al. | |
| D393,010 | S | 3/1998 | Beall | |
| D393,491 | S | 4/1998 | Yiu | |
| 5,735,527 | A | 4/1998 | Yiu | |
| 5,743,534 | A | 4/1998 | Pan | |
| D398,037 | S | 9/1998 | Drewes | |
| D403,361 | S | 12/1998 | Huang | |
| 5,954,339 | A | 9/1999 | Yiu | |
| 5,967,520 | A | 10/1999 | Chen | |
| 6,269,581 | B1 * | 8/2001 | Groh | F41G 3/06 42/122 |
| D453,360 | S | 2/2002 | Pan | |
| D455,461 | S | 4/2002 | Huang | |
| D455,811 | S | 4/2002 | Fedio | |
| 7,134,663 | B1 | 11/2006 | Lowe et al. | |
| D758,496 | S | 6/2016 | Biele | |
| D851,613 | S | 6/2019 | Johanson et al. | |
| D875,833 | S | 2/2020 | Fairchild | |
| D877,101 | S | 3/2020 | Johanson et al. | |
| D880,597 | S | 4/2020 | Mei | |
| D890,261 | S | 7/2020 | Chen | |
| 10,746,511 | B2 | 8/2020 | Howard | |
| D917,003 | S | 4/2021 | Howard | |
| 11,415,396 | B2 | 8/2022 | Howard | |
| 2002/0070501 | A1 | 6/2002 | Shao | |
| 2002/0113372 | A1 | 8/2002 | Love | |
| 2002/0158414 | A1 | 10/2002 | Yiu | |
| 2004/0016168 | A1 * | 1/2004 | Thomas | F41G 1/38 42/122 |
| 2006/0257825 | A1 * | 11/2006 | Jennings | F41J 1/00 434/16 |
| 2007/0063446 | A1 | 3/2007 | Pan et al. | |
| 2008/0054570 | A1 | 3/2008 | Potterfield et al. | |
| 2010/0259009 | A1 | 10/2010 | Huang | |
| 2012/0161396 | A1 | 6/2012 | Munn | |
| 2013/0040268 | A1 * | 2/2013 | Van der Walt | F41J 5/02 434/16 |
| 2016/0327377 | A1 | 11/2016 | Flynn | |
| 2019/0137226 | A1 | 5/2019 | Howard | |

OTHER PUBLICATIONS

Hawk, Chuck. "The Kill Zone of North American Big Game Animals," North American Animal Anatomy. chuckhawks.com. Accessed Nov. 5, 2018 <chuckhawks.com/kill_zone_game_animals.htm>, 4 p.

Hoppe, "Hoppe's No. 9 Critter Target Paper, Big Buck and Deer (Pack of 5)," Amazon.com. Accessed Nov. 5, 2018 <amazon.com/hoppes-critter-paper-targets-28x28-inch/dp/b000h6r082>, 1 p.

* cited by examiner

Target Generator
100

Target Generator
100

| | | | | | | | |
|---|---|---|---|---|---|---|---|
| WESTERN GAME | | | | | | | |
| | | | | | | | |
| ANIMAL | VITAL | 100 yds. | 200 yds. | 300 yds. | 400 yds. | 500 yds. | 600 yds. |
| Antelope | 9 | 8.594 | 4.297 | 2.865 | 2.149 | 1.719 | 1.432 |
| White Tail Deer | 10 | 9.549 | 4.775 | 3.183 | 2.387 | 1.910 | 1.592 |
| Mule Deer | 11 | 10.504 | 5.252 | 3.501 | 2.626 | 2.101 | 1.751 |
| Rocky Mtn. Elk | 15 | 14.324 | 7.162 | 4.775 | 3.581 | 2.865 | 2.387 |
| Moose | 18 | 17.189 | 8.594 | 5.730 | 4.297 | 3.438 | 2.865 |
| Mountain Goat | 12 | 11.459 | 5.730 | 3.820 | 2.865 | 2.292 | 1.910 |
| Bighorn Sheep | 11 | 10.504 | 5.252 | 3.501 | 2.626 | 2.101 | 1.751 |
| Desert Sheep | 11 | 10.504 | 5.252 | 3.501 | 2.626 | 2.101 | 1.751 |
| Bison * | 15 | 14.324 | 7.162 | 4.775 | 3.581 | 2.865 | 2.387 |
| Black Bear | 10 | 9.549 | 4.775 | 3.183 | 2.387 | 1.910 | 1.592 |
| Coyote | 6 | 5.730 | 2.865 | 1.910 | 1.432 | 1.146 | 0.955 |
| Fox | 4 | 3.820 | 1.910 | 1.273 | 0.955 | 0.764 | 0.637 |
| Bobcat | 4 | 3.820 | 1.910 | 1.273 | 0.955 | 0.764 | 0.637 |
| Grey Wolf | 8 | 7.639 | 3.820 | 2.546 | 1.910 | 1.528 | 1.273 |
| Wild Hog | 8 | 7.639 | 3.820 | 2.546 | 1.910 | 1.528 | 1.273 |
| | | | | | | | |
| Dall Sheep | 11 | 10.504 | 5.252 | 3.501 | 2.626 | 2.101 | 1.751 |
| Stone Sheep | 11 | 10.504 | 5.252 | 3.501 | 2.626 | 2.101 | 1.751 |
| Caribou | 15 | 14.324 | 7.162 | 4.775 | 3.581 | 2.865 | 2.387 |
| Yukon Moose | 18 | 17.189 | 8.594 | 5.730 | 4.297 | 3.438 | 2.865 |
| Grizzly Bear * | 10 | 9.549 | 4.775 | 3.183 | 2.387 | 1.910 | 1.592 |
| Brown Bear * | 13 | 12.414 | 6.207 | 4.138 | 3.104 | 2.483 | 2.069 |
| | | | | | | | |
| * Dangerous Game | | | | | | | |
| All dangerous game, one must use a maximum of 3.46" Vital area | | | | | | | |

Fig. 19A

| | | | | | | | |
|---|---|---|---|---|---|---|---|
| | | | | | | | |
| | | | | | | | |
| | | | | | | | |
| AFRICAN GAME | | | | | | | |
| | | | | | | | |
| Animal | Vital Size | 100 yds. | | | | | |
| Eland | 16 | 15.279 | | | | | |
| Buffalo * | 16 | 15.279 | | | | | |
| Hippo * | 16 | 15.279 | | | | | |
| Kudu | 15 | 14.324 | | | | | |
| Sable | 15 | 14.324 | | | | | |
| Nilgai | 15 | 14.324 | | | | | |
| Bongo | 15 | 14.324 | | | | | |
| Zebra | 14 | 13.369 | | | | | |
| Wildebeest | 14 | 13.369 | | | | | |
| Water Buck | 14 | 13.369 | | | | | |
| Gemsbuck | 12 | 11.459 | | | | | |
| Red Hartebeest | 12 | 11.459 | | | | | |
| Nayla | 12 | 11.459 | | | | | |
| Black Wildebeest | 12 | 11.459 | | | | | |
| Addax | 12 | 11.459 | | | | | |
| Blesbok | 11 | 10.504 | | | | | |
| African Lion * | 11 | 10.504 | | | | | |
| Impala | 8 | 7.639 | | | | | |
| Spotted Hyena | 8 | 7.639 | | | | | |
| Bush Buck | 8 | 7.639 | | | | | |
| Spring Bok | 8 | 7.639 | | | | | |
| Mtn. Red Buck | 8 | 7.639 | | | | | |
| Warthog | 8 | 7.639 | | | | | |
| Leopard * | 6 | 5.730 | | | | | |
| Black Buck | 6 | 5.730 | | | | | |
| Steenbuck | 5 | 4.775 | | | | | |
| Jackal | 5 | 4.775 | | | | | |
| Carracal | 4 | 3.820 | | | | | |
| Duiker | 4 | 3.820 | | | | | |
| | | | | | | | |
| * Dangerous Game | | | | | | | |
| All dangerous game must be considered to use a maximum of 3.46" diameter vital area | | | | | | | |

Fig. 19B

| | | | | | | | |
|---|---|---|---|---|---|---|---|
| VITAL AREA BY ANIMAL | | | | | | | |
| Animal sizes vary, vital areas based upon averages and allow for some tolerances. | | | | | | | |
| | | | | | | | |
| ANIMAL | Vital Size | | ANIMAL | Vital Size | | | |
| Antelope | 9 | | Eland | 16 | | | |
| White Tail Deer | 10 | | Buffalo * | 16 | | | |
| Mule Deer | 11 | | Hippo * | 16 | | | |
| Rocky Mtn. Elk | 15 | | Kudu | 15 | | | |
| Moose | 18 | | Sable | 15 | | | |
| Mountain Goat | 12 | | Nilgai | 15 | | | |
| Bighorn Sheep | 11 | | Bongo | 15 | | | |
| Desert Sheep | 11 | | Zebra | 14 | | | |
| Bison * | 15 | | Wildebeest | 14 | | | |
| Black Bear | 10 | | Water Buck | 14 | | | |
| Coyote | 6 | | Gemsbuck | 12 | | | |
| Fox | 4 | | Red Hartebeest | 12 | | | |
| Bobcat | 4 | | Nayla | 12 | | | |
| Grey Wolf | 8 | | Black Wildebeest | 12 | | | |
| Wild Hog | 8 | | Addax | 12 | | | |
| | | | Blesbok | 11 | | | |
| Dall Sheep | 11 | | African Lion * | 11 | | | |
| Stone Sheep | 11 | | Elephant * | 11 | | | |
| Caribou | 15 | | Impala | 8 | | | |
| Yukon Moose | 18 | | Bush Buck | 8 | | | |
| Grizzly Bear * | 10 | | Spring Bok | 8 | | | |
| Brown Bear * | 13 | | Mtn. Red Buck | 8 | | | |
| Mtn. Lion * | 9 | | Warthog | 8 | | | |
| | | | Spotted Hyena | 8 | | | |
| | | | Leopard * | 6 | | | |
| | | | Black Buck | 6 | | | |
| | | | Steenbuck | 5 | | | |
| | | | Jackal | 5 | | | |
| | | | Carracal | 4 | | | |
| | | | Duiker | 4 | | | |
| | | | | | | | |
| * DENOTES DANGEROUS GAME | | | | | | | |
| All dangerous game must use a maximum of 3.46 inch vital area | | | | | | | |
| Consult PH/Guide for vital area size | | | | | | | |

Fig. 19C

| Vital size with yardage size calculations | | | | | | |
|---|---|---|---|---|---|---|
| | | | | | | |
| VITAL | 100 yds. | 200 yds. | 300 yds. | 400 yds. | 500 yds. | 600 yds. |
| 3 | 2.865 | 1.433 | 0.955 | 0.716 | 0.573 | 0.478 |
| 4 | 3.820 | 1.910 | 1.273 | 0.955 | 0.764 | 0.637 |
| 5 | 4.775 | 2.388 | 1.592 | 1.194 | 0.955 | 0.796 |
| 6 | 5.730 | 2.865 | 1.910 | 1.433 | 1.146 | 0.955 |
| 7 | 6.685 | 3.343 | 2.228 | 1.671 | 1.337 | 1.114 |
| 8 | 7.639 | 3.820 | 2.546 | 1.910 | 1.528 | 1.273 |
| 9 | 8.594 | 4.297 | 2.865 | 2.149 | 1.719 | 1.432 |
| 10 | 9.549 | 4.775 | 3.183 | 2.387 | 1.910 | 1.592 |
| 11 | 10.504 | 5.252 | 3.501 | 2.626 | 2.101 | 1.751 |
| 12 | 11.459 | 5.730 | 3.820 | 2.865 | 2.292 | 1.910 |
| 13 | 12.414 | 6.207 | 4.138 | 3.104 | 2.483 | 2.069 |
| 14 | 13.369 | 6.685 | 4.456 | 3.342 | 2.674 | 2.228 |
| 15 | 14.324 | 7.162 | 4.775 | 3.581 | 2.865 | 2.387 |
| 16 | 15.279 | 7.640 | 5.093 | 3.820 | 3.056 | 2.547 |
| 17 | 16.224 | 8.112 | 5.408 | 4.056 | 3.245 | 2.704 |
| 18 | 17.189 | 8.595 | 5.730 | 4.297 | 3.438 | 2.865 |
| 19 | 18.144 | 9.072 | 6.048 | 4.536 | 3.629 | 3.024 |
| 20 | 19.099 | 9.550 | 6.366 | 4.775 | 3.820 | 3.183 |

Fig. 20

| | 100 yds. | 200 yds. | 300 yds. | 400 yds. | 500 yds. | 600 yds. |
|---|---|---|---|---|---|---|
| Target Size 10" Corrected | 9.55 | 4.775 | 3.18 | 2.388 | 1.91 | 1.592 |
| Angle Calculations | 9.55 | 4.776 | 3.18 | 2.388 | 1.99 | 1.596 |
| | | | | | | |
| Bullet Spread Angle | | | | | | |
| Target size 10" | 0.1592 | 0.0796 | 0.053 | 0.0398 | 0.0318 | 0.0266 |
| Target size 9.55" | 0.152 | 0.152 | 0.0506 | 0.038 | 0.0304 | 0.254 |

| Angle Calculations | | 10" angle | 1/2 @100 | 100 yds | 9.55 angle | 1/2 @100 | 100 yds. |
|---|---|---|---|---|---|---|---|
| 10", 1/2 vertical | 100 | 0.0796 | 5.001 | 10.002 | 0.076 | 4.775 | 9.55 |
| | 200 | 0.0398 | 2.501 | 5.002 | 0.038 | 2.388 | 4.776 |
| | 300 | 0.0265 | 1.665 | 3.33 | 0.0253 | 1.59 | 3.18 |
| | 400 | 0.0199 | 1.25 | 2.5 | 0.019 | 1.194 | 2.388 |
| | 500 | 0.0159 | 0.999 | 1.998 | 0.0152 | 0.995 | 1.99 |
| | 600 | 0.0133 | 0.836 | 1.672 | 0.127 | 0.798 | 1.596 |

Fig. 21

BULLET SPREAD

AS YARDAGE INCREASES

| | BULLET GROUPING SIZES AT 100 YARDS - MOA | | | | | | |
|---|---|---|---|---|---|---|---|
| Yardage | Grouping Size Dia. | Grouping Size Dia. | Grouping Size Dia. | Grouping Size Dia. | Grouping Size Dia. | Grouping Size Dia. | Grouping Size Dia. |
| 100 yards | 1 inch' | 2 inch' | 3 inch' | 4 inch' | 5 inch' | 6 inch' | 7 inch' |
| | Spreads to these diameters as yardage increases | | | | | | |
| 200 yards | 2.09" | 4.19" | 6.28" | 8.38" | 10.47" | 12.56" | 14.66" |
| 300 yards | 3.14" | 6.28" | 9.42" | 12.56" | 15.70" | 18.84" | 21.99" |
| 400 yards | 4.19" | 8.38" | 12.56" | 16.75" | 20.94" | 25.13" | 29.32" |
| 500 yards | 5.23" | 10.47" | 15.70" | 20.94" | 26.18" | 31.38" | |
| 600 yards | 6.28" | 12.56" | 18.85" | 25.13" | 31.41" | | |
| 700 yards | 7.33" | 14.66" | 21.99" | 29.32" | | | |
| 800 yards | 8.38" | 16.75" | 25.13" | 33.50" | | | |
| 900 yards | 9.42" | 18.85" | 28.26" | 37.69" | | | |
| 1000 yards | 10.47" | 20.94" | 31.41" | 41.88" | | | |

Fig. 22

APPARATUS FOR GENERATING A VITALS TARGET

CROSS-REFERENCE TO RELATED APPLICATION

This patent application is a continuation of U.S. patent application Ser. No. 17/878,447 titled APPARATUS FOR GENERATING A VITALS TARGET, filed Aug. 1, 2022, which is a continuation of U.S. patent application Ser. No. 16/983,447 titled APPARATUS FOR GENERATING A VITALS TARGET, filed Aug. 3, 2020, which is a continuation application that hereby claims priority to and the benefit of U.S. patent application Ser. No. 16/182,339 titled APPARATUS FOR GENERATING A VITALS TARGET, filed Nov. 6, 2018, and U.S. Provisional Patent Application No. 62/581,982, filed Nov. 6, 2017, all of which are incorporated herein by reference in their entirety.

TECHNICAL FIELD

The disclosure relates generally to an apparatus for generating targets; specifically, an apparatus generating vitals targets that measure accuracy for a plurality of different distances.

BACKGROUND

Marksmanship is vital in a number of different sports. Whether it be hunting, shooting, air guns, or archery, marksmanship is used to measure skill and prowess. Marksmanship is also used to prepare for ethical hunting expeditions.

Individuals practicing marksmanship may do so at a practice range allowing for practice at a known distance. Practice ranges may not include the distance required during a hunting expedition. Individuals may estimate the skill needed for an ethical hunting expedition as it correlates to the distance available for a practice range.

When an individual is not sufficiently practiced to be accurate at the distance used in the hunting expedition the animal hunted may not be ethically harvested.

SUMMARY

An apparatus for generating a vitals target may include a processor, an output device, and a non-transitory storage medium. The output device is communicatively connected to the processor. The non-transitory storage medium may include a number of modules. The number of modules may include a target distance identify module, a target animal identify module, a vital zone determine module, a first distance identify module, and a target calculate module. The target distance may identify module that identifies a target set distance for a target configuration. The target animal identify module may identify an animal being simulated. The vital zone determine module may determine the shape of a vital zone. The first distance identify module may identify a first distance being simulated at the target set distance. The target calculate module may render the vital zone for a target distance. The output generate module may cause the output device to generate a vitals target.

A computer program product for generating a vitals target on a device is disclosed. The computer program product may include a memory resource. The memory resource may include computer program code to cause a computer to perform a particular operation. The memory resource may include a target distance identifier, a target animal identifier, a vital zone determiner, a first distance identifier, a second distance identifier, a direction determiner, a target calculator, a trajectory calculator, and an output generator. The target distance identifier may cause the device to identify a target set distance for a target configuration. The target animal identifier may cause the device to identify an animal being simulated. The vital zone determiner may cause the device to determine the shape of a vital zone. The first distance identifier may cause the device to identify a first distance being simulated at the target set distance. The second distance identify module may cause the device to identify a second distance being simulated. The direction determiner may cause the device to simulate a rotation of a vital zone to simulate an animal standing at a determined angle. The target calculator may cause the device to render the vital zone for a target distance. The trajectory calculator may cause the device to calculate a trajectory of a projectile. The output generator may cause the device to generate a vitals target.

An apparatus for training marksmanship is disclosed. The apparatus may include a vitals target. The vitals target may include an image of an animal, a number of vital zones, and a number of amulets. The image of an animal indicating an animal that may be hunted is disclosed. Each of the plurality of vital zones indicates the vital zone of an animal to strike for a humane hunt. The amulets may be the area between two vital zone outlines. The amulets may represent the difference in grouping size used for an ethical hunt.

BRIEF DESCRIPTION OF THE DRAWINGS

A more particular description of the invention briefly described above is made below by reference to specific examples. Several examples are depicted in drawings included with this application. An example is presented to illustrate, but not restrict, the invention.

FIGS. 19A and 19B illustrate a chart of target vital design information.

FIG. 19C illustrates a chart of vital area by animal.

FIG. 20 illustrates a chart of vital size with yardage size calculations.

FIG. 21 illustrates a chart of target sizes, angle calculations, and bullet spread calculations.

FIG. 22 illustrates a chart of bullet grouping spread.

DETAILED DESCRIPTION

Figure 1:
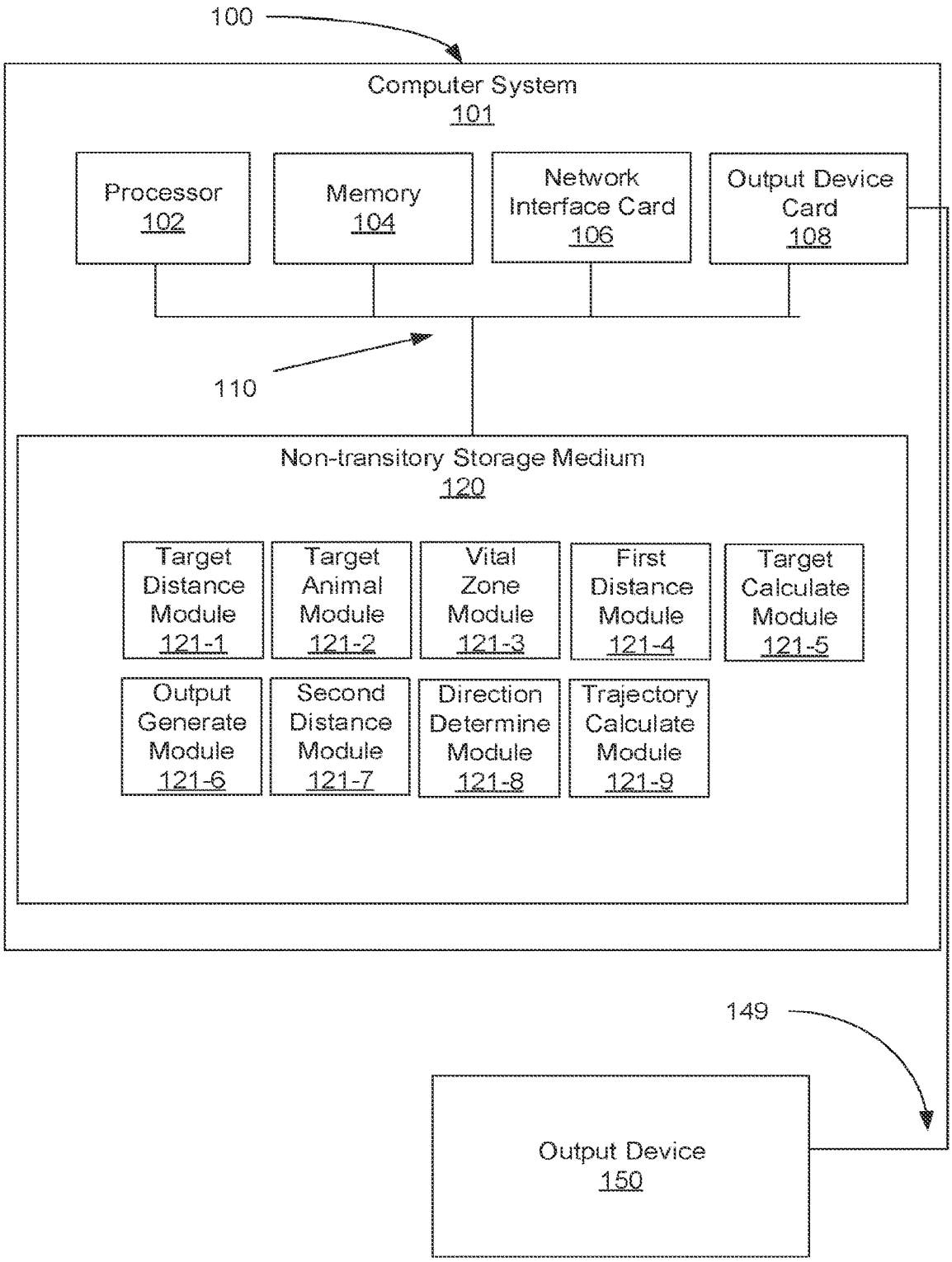
FIG. 1 illustrates an apparatus for generating vitals targets according to one example of the principles described herein.

A detailed description of the claimed invention is provided below by example, with reference to examples in the appended figures. Those of skill in the art will recognize that the components and steps of the invention as described by example in the figures below could be arranged and designed in a wide variety of different configurations, without departing from the substance of the claimed invention. Thus, the detailed description of the examples in the figures is merely representative of an example of the invention and is not intended to limit the scope of the invention as claimed.

In some instances, numerical values are used to describe features such as spreading factors, angle, trajectory, and distances. Though precise numbers are used, one of skill in the art recognizes that small variations in the precisely stated values do not substantially alter the function of the feature being described. In some cases, a variation of up to 50% of the stated value does not alter the function of the feature. Thus, unless otherwise stated, precisely stated values should be read as the stated number, plus or minus a standard variation common and acceptable in the art.

For purposes of this disclosure, the modules refer to a combination of hardware and program instructions to perform a designated function. Each of the modules may include a processor and memory. The program instructions may be stored in the memory and cause the processor to execute the designated function of the modules.

Identifying and targeting a vital zone is a valued skill for marksmen and hunters. The vital zone for any animal may be shaped in three dimensions. While the vital zone may be irregularly shaped, it may be represented by a circle, triangle, rectangle, oval, oblong, or other shapes including irregular shapes within the vital zone area that provides proper shot placement for an ethical hunt. Scoring of a target may include that all shots are placed within a vital zone.

A purpose of the claimed apparatuses, methods, and systems is to facilitate and enhance the use of a computing device. One example of the apparatus is a computer with a printer used to generate vitals targets that can be used at a marksmanship range when the apparatus is not present. Another example is a computer program product used to generate vitals targets that are used at a marksmanship range. Yet another example is an apparatus for training marksmanship that includes a target. The target includes an image of an animal, a plurality of vital zones, and a number of amulets. The target can be used at a known distance to simulate the accuracy needed for an ethical hunt at a different distance.

As used in the present specification, projectile refers to an object being propelled from a device, such as a firearm, air gun, or a bow and arrow, toward a target.

As used in the present specification, ammunition refers to a projectile, a powder charge, and an ignition source. When the ignition source is activated it ignites the powder charge which causes the projectile to be expelled from a firearm.

As used in the present specification, modern ammunition refers to ammunition that has a projectile, a powder charge, a case, and a primer. The primer is the ignition source for the powder that is activated by pressure. The primer ignites the powder charge. The ignited powder charge is contained by the case, causing the expanding gases to propel the projectile out of a firearm.

As used in the present specification and in the appended claims, ballistics coefficient refers to a numerical value effecting the flightpath of a projectile.

As used in the present specification and in the appended claims, vitals zone refers to a target area of an animal representing the vital organs. If the vital zone of an animal is hit by a projectile, it is most likely to cause the quick death of the animal which prevents the animal from suffering unnecessarily.

As used in the present specification and in the appended claims, muzzle refers to the end of a barrel of a firearm from whence a projectile is expelled.

As used in the present specification and in the appended claims, trajectory refers to the flightpath of a projectile between the time it is released from a device and its position during flight. The trajectory may be affected by the speed of the projectile, the ballistic coefficient, and gravity.

As used in the present specification and in the appended claims, a number refers to a whole number of the value one or greater, zero, not being a number, but rather being the absence of a number.

As used in the present specification and in the appended claims, plurality refers to two or more of an item.

As described above, an apparatus for generating a vitals target allows for a marksman to practice a plurality of distances at a shorter distance for receiving feedback as to the accuracy required for longer distance. Additionally, a marksman may measure improvement over time and identify a distance where the marksman can engage in an ethical hunt. By being able to readily practice a variety of distances and vital targets, marksmen may improve their skill for ethical hunting. Ethical hunting may improve the survival rates of a number of species effected by ethical hunts. An ethical hunt may reduce the burden of one species on an area of land, which allows for other species to flourish. An ethical hunt may be used to reduce predators in an area, allowing an endangered species to grow and populate an area.

For example, if there are too many deer in an area, the deer may over consume vegetation resulting in insufficient vegetation for other species. Additionally, the overconsumption of vegetation may cause the deer in an area to become ill or sickly due to the unavailability of food. The overconsumption of vegetation may cause erosion due to the lack of vegetation, which may have permanent and lasting effects on land usage. An ethical hunt may control the population of the species, to allow other species, and/or even that species to populate the area.

Marksmen may find it easier to practice accuracy and learn vital targets at a structured shooting range, where marksmanship is practiced and measured under known conditions and known distances. A marksman may choose the practice arena, as it allows for greater frequency of shots and better feedback on each individual shot. Thus, over time a marksman may improve faster in a structured practice area than in a hunt. Additionally, a marksmen that engages in practice is less likely to cause pain and suffering for an animal through a missed or poorly placed shot.

Additionally, some marksmen prefer to show off their accuracy and prowess without engaging in hunting. Such simulated activities may provide for entertainment and enjoyment while measuring a valuable skill, whether or not that skill is actually used in hunting.

The disclosed target may be adapted to simulate the relative vital size of different animals at different distances. For example, an animal with a vital size of substantially ten inches when viewed from 100 yards may appear to be substantially five inches when viewed from 200 yards.

In the preferred embodiments, the target may have multiple rings. In the preferred embodiments the target may have six concentric rings with a bullseye located at the center of each of the rings. The outer ring may be the ring with the longest diameter, the second ring may be the ring with the second longest diameter, the third ring may be the ring with the third longest diameter, the fourth ring is the ring with the fourth longest diameter, the fifth ring is the fifth ring with the fifth longest diameter, and the sixth ring is the sixth ring with the sixth longest diameter. The target may have anywhere between one ring and one hundred rings.

In some embodiments, the outer ring may correspond to a ten inch vital diameter and may have a length correction equal to ten inches divided by 1.047. In some embodiments the length correction is determined by dividing by 1.047. The 1.047 figure may be determined by using an angle subtended multiplied by 0.95493. An inverted or reciprocal of "1 MOA" at 100 yards, which is 1/1.047, may be used to confirm the diameter or dimensions of the ring representing the area of an animal's vitals as viewed from 100 yards; a bullet spread calculation may be used to confirm that the concentric rings reflect the shooters accuracy at the long distances.

In the preferred embodiments, a target also has one or more horizontal lines to provide a guide. In the preferred embodiments, a target may have three horizontal lines; the first line may represent a 2 inches sight mark; the second line may represent a 3 inch sight mark; the third line may represent a 4 inch sight mark. In some embodiments, a first horizontal line is positioned 2 inches below the horizontal center line of the target; in other embodiments, a second horizontal line is paced 3 inches below the horizontal center line of the target; in some embodiments a third horizontal line is placed 4 inches below the horizontal center line of the target; in some embodiments, a target may have a first horizontal line, a second horizontal line, and a third horizontal line. For one or more of the horizontal lines, a vertical line may be positioned perpendicular to the corresponding horizontal lines. This vertical-horizontal line may allow a shooter to align his or her scope both horizontally and vertically. This vertical-horizontal line may be useful to the shooter so that the shooter may aim at the target without having to tilt his or her scope since tilting may impact the shooter's accuracy. The target may be used by a shooter made to measure one's accuracy and may also be used by a shooter to improve the shooter's accuracy. A hunter with a gun sighted to be 2 inches high at 100 yards may then aim for the 2 inch horizontal mark and may be more likely to hit the target substantially near the center of the bullseye. The 2 inch horizontal mark is positioned so that a hunter with the gun sighted to be 2 inches high at 100 yard should, if all other factors are controlled, may then be more likely to hit the target substantially near the center of the bullseye.

A hunter with a gun sighted to be 3 inches high at 100 yards may then aim for the 3 inch horizontal mark and may be more likely to hit the target substantially near the center of the bullseye. The 3 inch horizontal mark is positioned so that a hunter with the gun sighted to be 3 inches high at 100 yard should, if all other factors are controlled, may then be more likely to hit the target substantially near the center of the bullseye.

A hunter with a gun sighted to be 4 inches high at 100 yards may then aim for the 4 inch horizontal mark and may be more likely to hit the target substantially near the center of the bullseye. The 4 inch horizontal mark is positioned so that a hunter with the gun sighted to be 4 inches high at 100 yard should, if all other factors are controlled, may then be more likely to hit the target substantially near the center of the bullseye.

The targets may have a written explanation for how to measure one's effective range using a five shot parameter for the number of shots needed to determine a true shooting pattern and use this as a measurement system. A method of use may include shooting a certain percentage of bullets into a certain ring to help determine ethical effective range of the shooter and shooting position.

In some embodiments, an outer ring of the target has a diameter; the diameter of the outer ring of the target may be associated with a shooting distance such as 100 yards at which a shooter may shoot from to simulate shooting at the vital area of a certain species of animal. For example, the diameter of a ring of the target may equal ten inches; the diameter of a ring of the target may simulate the relative size of an antelope's vital area as viewed by a shooter who is located substantially 100 yards from the target. Additional distances may be associated with different diameters of different rings.

Referring now to the figures, FIG. 1 illustrates an apparatus for generating a vitals target. The target generator (100) includes a computer system (101) communicatively connected using a communication cable (149) to an output device (150). In some embodiments a wireless connection is used instead of a communication cable (149).

The computer system (101) may include a processor (102), memory (104), a network interface card (106), and an output device card (108) that are communicatively connected through a communication bus (110) with a non-transitory storage medium (120).

The non-transitory storage medium (120) may include a number of modules (121). The number of modules may include a combination of software, hardware, or both to perform a particular task. In this example, the non-transitory storage medium (120) may include a target distance module (121-1), a target animal module (121-2), a vital zone module (121-3), a first distance module (121-4), a target calculate module (121-5), an output generate module (121-6), a second distance module (121-7), a direction determine module (121-8), and a trajectory calculate module (121-9).

The target distance module (121-1) calculates a distance at which the vital zone target may be used at. The target distance module may generate a target based on a common distance for practicing marksmanship. For example, in handgun marksmanship, popular distances may include 7 yards, 10 yards, 15 yards, 17 yards, or 25 yards. Similar distances may be calculated using metric values. In another example, in rifle marksmanship popular distances may include 25 yards, 50 yards, 100 yards, and 200 yards. The target distance module (121-1) identifies one target distance where the target is designed to be used.

The target animal module (121-2) identifies an animal for which a vital zone will be selected. For example, the target animal module (121-2) may identify a wild boar as the target animal. In another example, the target animal module (121-2) may identify an elk, deer, bear, turkey, elephant, lion, mountain lion, or other animal which may be targeted.

The vital zone module (121-3) identifies the vital zone of the animal identified by the target animal module (121-2). Each animal may have a different vital zone. Further, the vital zone may actually be representative of a three-dimensional space in the animal where the vital organs are most likely to be. Identifying the vital zone may require identifying an angle at which the target animal may be presenting itself in relationship to the marksman. The vital zone module (121-3) may use infrared sensors to determine the vital zone based on heated areas of an animal. A three-dimensional vital zone may be represented in two dimensions by showing the outline of the vital zone from a desired perspective.

The first distance module (121-4) may identify a first distance to be emulated at the target distance. For example, a target distance of 50 yards may be identified. The first distance module (121-4) may identify a target distance of 100 yards. The target generator (100) may then use various calculations to represent the accuracy needed at 50 yards in order to hit the vitals zone at 100 yards.

The target calculate module (121-5) may calculate the size of the target based on a combination of the target distance, the vital zone, and the direction an animal is being emulated stand. The target calculate module (121-5) may consider the trajectory of a projectile in identifying the target size.

The target calculate module (121-5) may calculate the size of the target at the by taking a point from whence the projectile may be released to a figurative vital zone target at the simulated distance. Geometric calculations may then measure the angle from the point of release to the outer edges of a two-dimensional vital zone. Mathematical formulas, such as the Pythagorean Theorem, may be used to calculate the size of the target at the target distance.

The output generate module (121-6) may create output that a marksman may use for marksmanship practice. In one example, the output generate module (121-6) may cause a printer associated with the computer system (101) to print a target that may be used by the marksman. In another example, the output generate module (121-6) may control an input and output device that causes a target to be projected in front of a marksman while measuring a simulated projectile from the marksman. In yet another example, the output generate module (121-6) may control an output device that projects a virtual target in front of the marksman. A sensor may be used to read where an actual projectile from the marksman strikes the projected target.

A second distance module (121-7) may calculate a second distance for which a vital zone may be represented on a single target. For example, a target distance of 50 yards may have a vital zone presentation for both 50 yards and 100 yards. Additional distances may be identified by the second distance module (121-7).

A direction determine module (121-8) may determine the presentation direction of a target animal in relation to the marksman. The direction the animal is facing may determine the two-dimensional shape of the vital zone as presented to the marksman. For example, the direction determine module (121-8) may determine that an animal is looking straight at the marksman. The animal looking straight at the marksman may present a particular shape of the vital zone. In another example, the animal is facing away from the marksman at a 90° angle in what is called a broadside shot. This may present a different shape of the vital zone.

The target generator (100) may use a trajectory calculate module (121-9) which considers the trajectory of a projectile. The trajectory calculate module (121-9) may consider the variance in angle from which a projectile is expelled. The trajectory calculate module (121-9) may consider the ballistic coefficient of the projectile. The trajectory calculate module (121-9) may consider the effects of gravity on the projectile over time during the flight of the projectile.

An overall example according to FIG. 1 will now be given. A target distance is identified by the target generator (100) using the target distance module (121-1). A target distance of 50 yards is identified.

A target animal is identified by the target generator (100) using the target animal module (121-2). A target animal of a male white-tail deer is identified.

A vital zone is identified by the target generator (100) using the vital zone module (121-3). A three-dimensional understanding of the vital zone of a male white-tail deer may be identified.

A first distance at the first distance when being shot at the target distance. The first distance may be the target distance or the first distance may be different than the target distance. In this example, the first distance module (121-4) identifies 50 yards as the first distance being simulated.

A second distance is identified by the target generator (100) using the second distance module (121-7) to determine the size of the vital zone as though the vital zone is at the second distance when being shot at the target distance. In this example, the second distance module (121-7) identifies 100 yards as the second distance being simulated.

A direction of the target animal may be identified by the target generator (100) using a direction determine module (121-8). In this example, the direction determine module (121-8) identifies that the animal is facing to the right of the marksman, providing a broadside shot.

A projectile trajectory may be calculated by the target generator (100) using the trajectory calculate module (121-9). The projectile trajectory may be used in calculating the size and placement of the target.

A target shape and size may be determined using the target calculate module (121-5). In this example, the target calculate module calculates a vital zone target for 50 yards and 100 yards as sized to be aimed at 50 yards. The projectile trajectory may be used to place the targets to account for the gravitational drop and projectile angle as varied between 50 yards and 100 yards.

Figure 2:
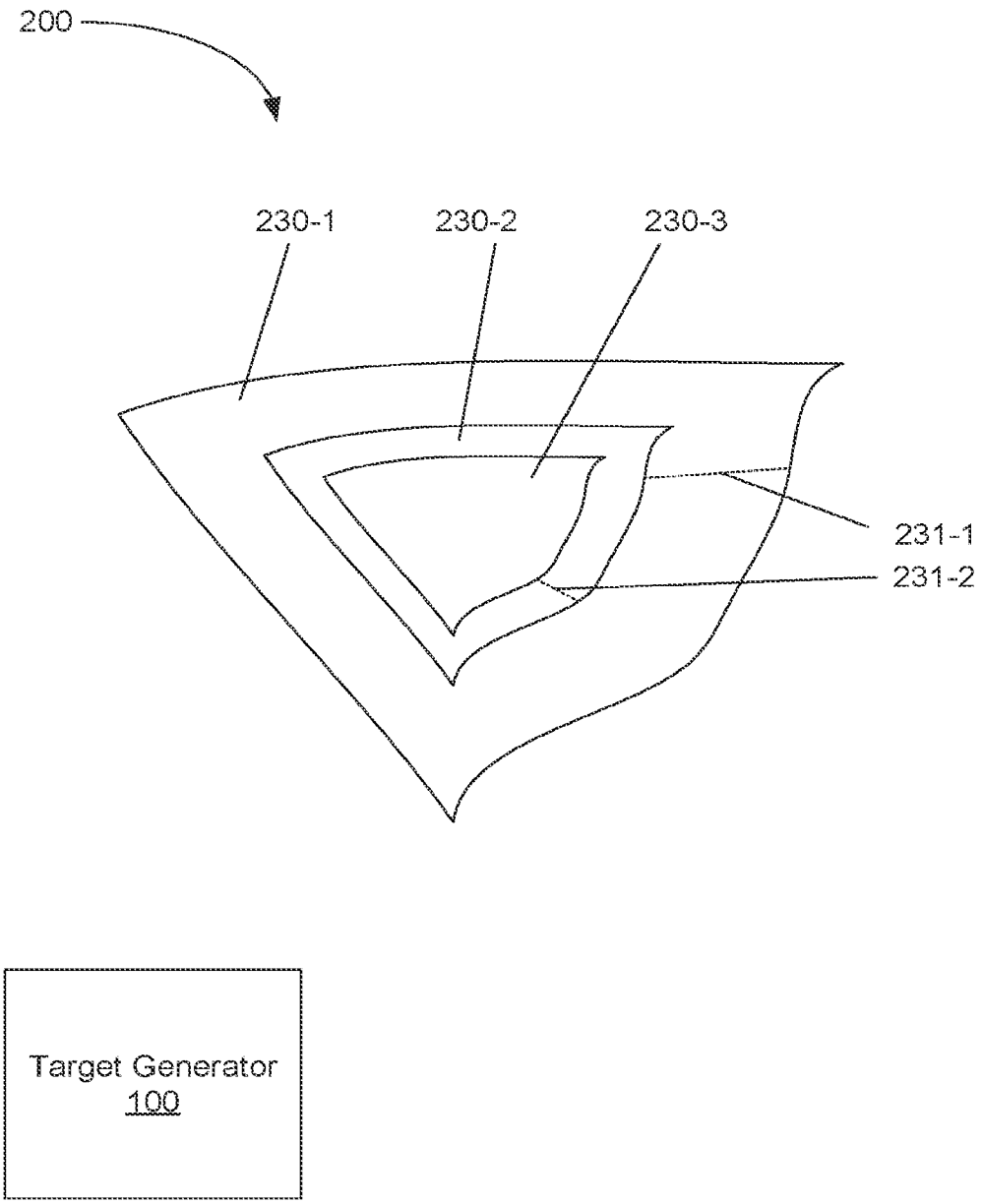
FIG. 2 illustrates an apparatus for training marksmanship including a plurality of vital zones according to the principles described herein.

FIG. 2 illustrates a vital zone target (200) that may be created by a target generator (100), according to one example of the principles described herein.

In this example, a number of vital zone targets (2300) are illustrated. In this example, the vital zone targets (2300) are concentric and may represent the accuracy needed by a marksman to hit a vital zone at a given distance. The area between vital zones may be referred to as an amulet. The size of the amulet may be measured in the distance between a plurality of vital zones. The distance between vital zones may vary significantly depending on the distance the vital zone represents. An overall example using FIG. 2 will now be given.

Each of the vital zone targets (2300) may represent a vital zone at a given distance. In this example, the vital zone target (2300) is being presented at 25 yards. The first vital zone (230-1) may represent the vital zone at 25 yards. The second vital zone (230-2) may represent the accuracy needed by the marksman for an effective shot at 50 yards.

The difference in the targets may create an amulet distance (231-1) that represents the increased accuracy needed to hit the vital zone target (2300) at the longer distance.

The third vital zone (230-3) may represent the vital zone at 100 yards. The amulet distance (232-2) between the second vital zone (230-2) and the third vital zone (230-3) may represent the increased accuracy needed to strike the vital zone at 100 yards.

Figure 3:
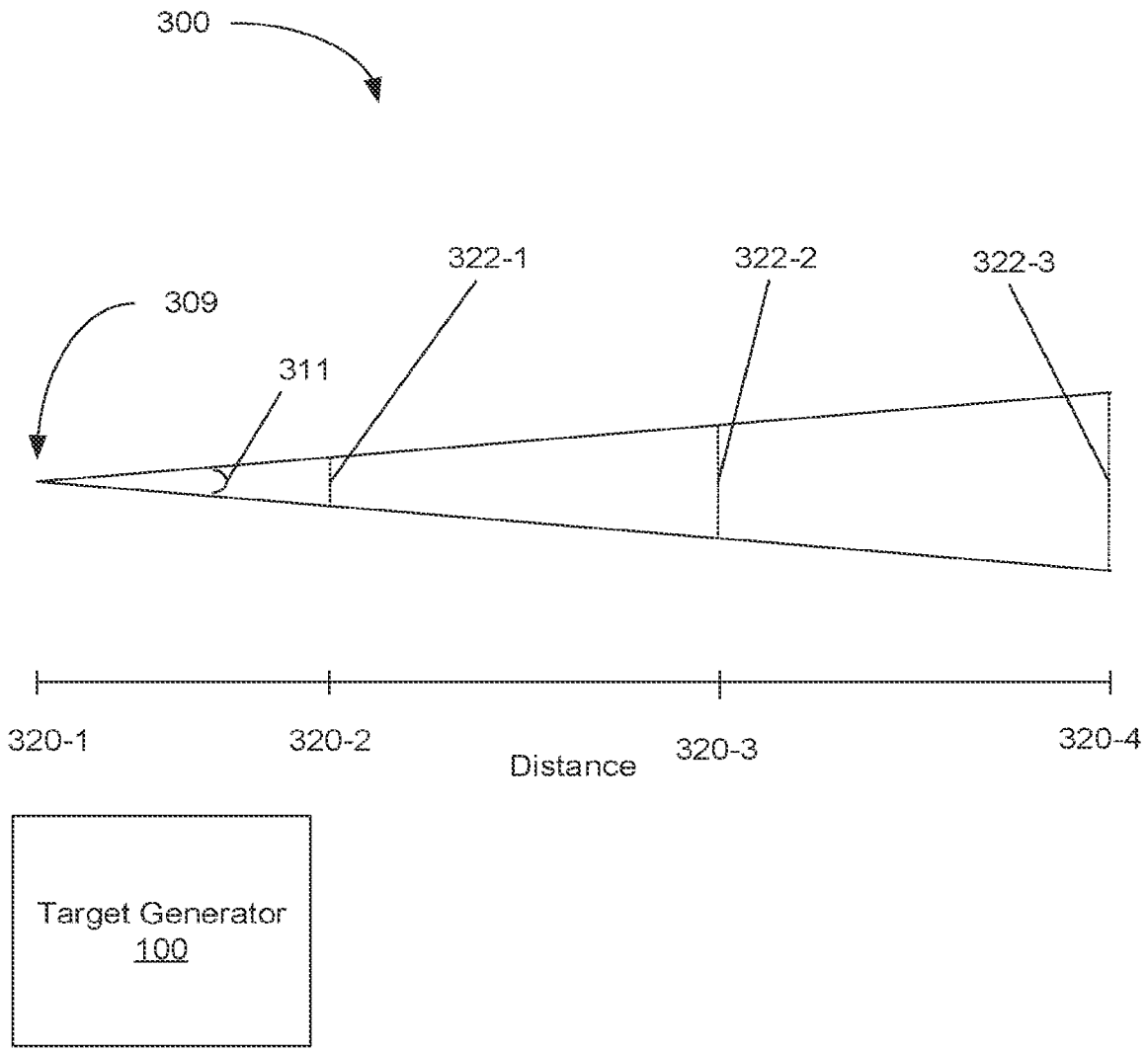
FIG. 3 illustrates trajectory calculations that may be used by a target generator.

FIG. 3 illustrates an example (300) of the effect of an angle at the marksman's release and its effect on accuracy over distance. As described here, the marksman will be described using a firearm. Similar effects are used in other projectile devices, such as air guns, bows and arrows, and throwing objects.

The shooting position (309) may represents the barrel of a firearm. The path of the projectiles may be determined by slight variances in the barrel and the muzzle of the firearm. Minor variances at the shooting position (309) may have significant effects over a long distance. For example, a non-discernible variation in the shooting position may be unmeasurable at 7 yards, but may provide for a target miss at distances over 1000 yards.

The angle of movement (311) of the shooting position (309) may cause these variations. The angle of movement is a two-dimensional angle that includes both left and right and up and down components. One may think of the angle of movement as creating a cone in which the projectile will travel when released. Marksmen spend a great deal of time and effort reducing the size of the angle of movement (311). Additionally, the device used, such as a firearm, may affect the angle of movement. Some marksmen will expend significant time, money, and resources minimizing the angle of movement.

The measurement of the angle of movement may be measured in minute of angle, or MOA. An MOA represents a movement of 1/60th of a degree.

At close distances, the angle of movement may have minor effects. For example, the size of the target zone at a known first distance (320-2) may create a target zone (322-1). At a longer distance (320-3), a larger target zone (322-2) occurs. At a still longer distance (320-4) an even larger target zone (322-3) occurs.

Figure 4A:
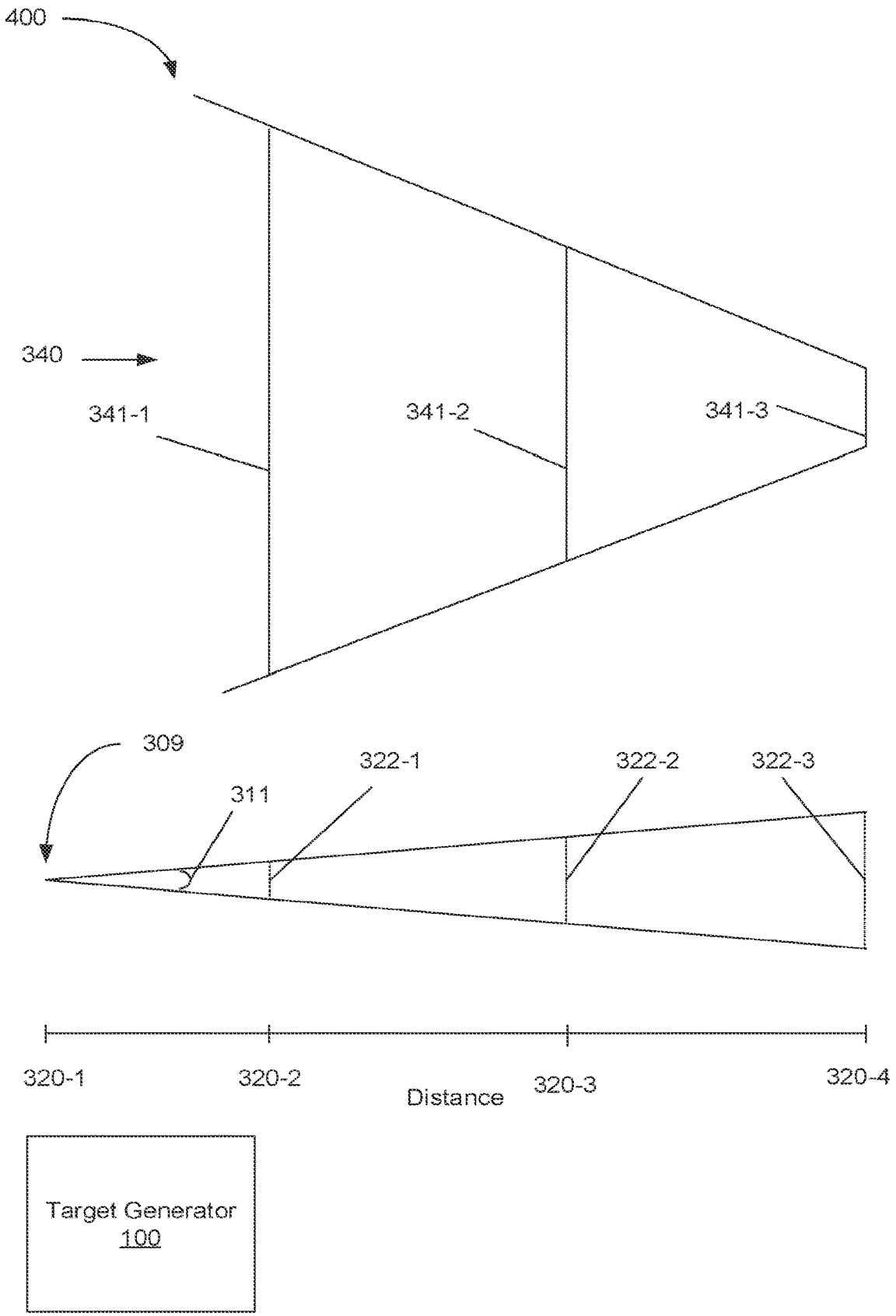
FIG. 4A illustrates trajectory calculations that may affect the size of a vitals target at a distance.

FIG. 4A is an illustration (400) of the effect of the angle of movement (311) over various distances as it relates to accuracy. The size of a target (340) may vary the accuracy needed depending on the distance the target is presented at. For example, to hit a target of a specified size at a first distance (320-2) may allow for a variance creating a large target (341-1). At a longer distance (320-3), the target may present as being smaller (341-2), requiring more accuracy. At the longest distance (320-4) the target presents as being smaller (341-3) requiring the most accuracy to hit.

Figure 4B:
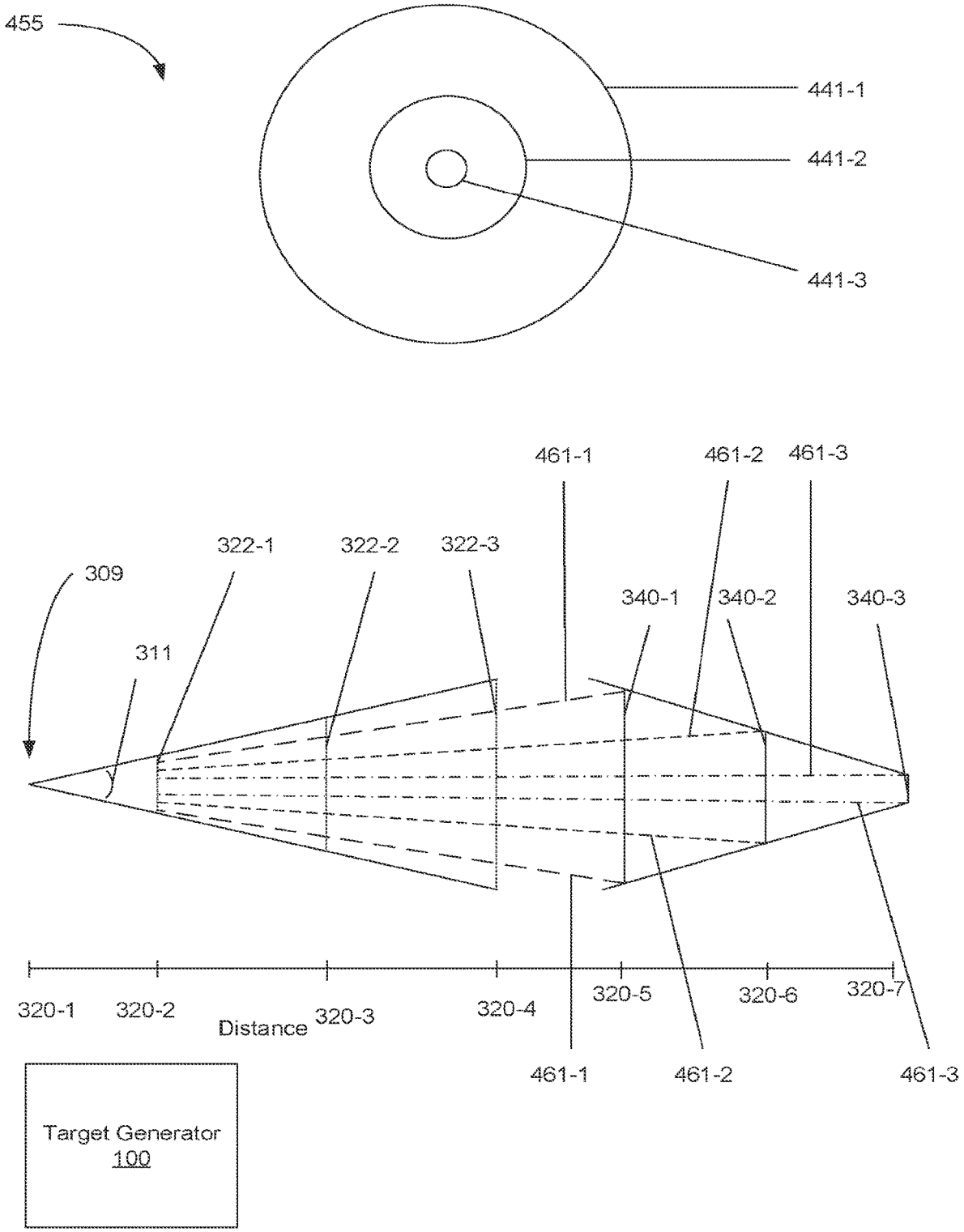
FIG. 4B illustrates the effects of trajectory calculations on the size of a vitals target.

FIG. 4B is an illustration (455) of the effects of distance on the accuracy needed to strike a target of a particular size. Here the shooting position (309) and angle of movement (311) create variances in a trajectory path. In simulating a constant size target at varying distances, different levels of accuracy are required. Accuracy can be determined by controlling the angle of movement (311). In this example for a first distance (320-5) the angle of movement may be restricted to keep the projectile within a target zone (461-1). In order to hit the target at this first distance (320-5) at a first target (340-1) a smaller placement of projectiles is required. In order to hit this first target (340-1) the angle of movement (311) may be restricted to be within a target zone (461-1). In order to hit the target at a second distance (320-6) a second target (340-2) is identified. In order to hit the second target (340-2) the angle of movement is restricted to be within a second path (461-2). In order to hit the target at a third distance (320-7) a third target (340-3) is identified. In order to hit the third target (340-3) the angle of movement is restricted within a third path (461-3).

The first target (340-1), second target (340-2), and third target (340-3) may be presented as shaded or line art on paper for a target. In this example the outline of the first target (340-1) is illustrated as a ring (441-1). The outline of the second target (340-2) corresponds to a different ring (441-2). The outline of the third target (340-3) corresponds to yet a different ring (441-3). The number of rings create a number of amulets, which may have different distances between them. The different distances represent the improved level of accuracy necessary to strike the fixed size target at the varying distances. Additionally, the rings may or may not be circular, but may also represent the outline of the vital zone that has been selected by the target generator (100). The rings may be a circle, triangle, rectangle, oval, oblong, or other geometric shapes including irregular shapes.

Figure 5:
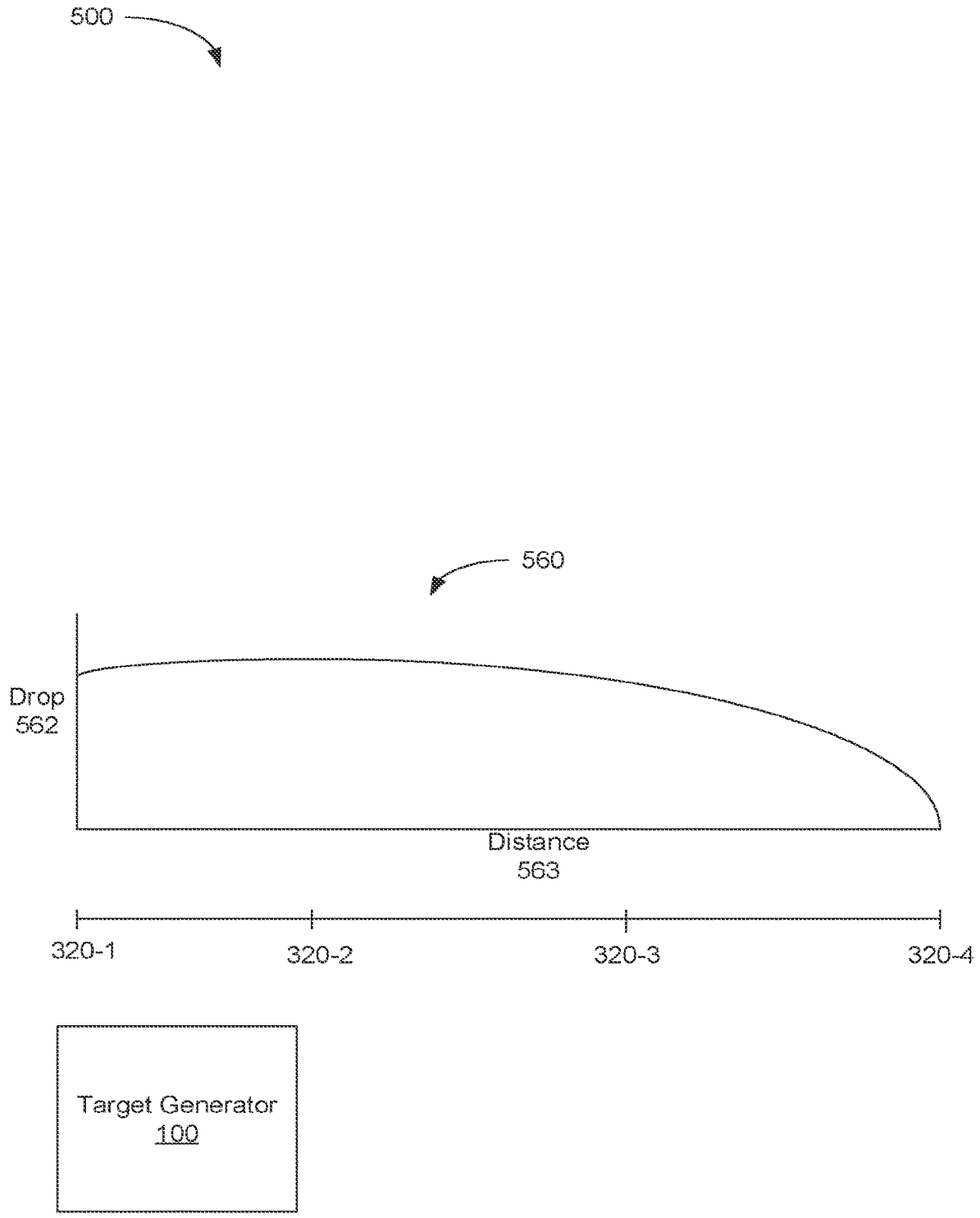
FIG. 5 illustrates a flightpath of a projectile over distance as may be used in calculations by a target generator.

FIG. 5 is an illustration (500) of a trajectory of a projectile as used by the target generator (100). A first distance (FIG. 3, 320-1) represents a shooting position (FIG. 3, 309) of a marksman. The shooting position (FIG. 3, 309) represents a zero distance or a distance where the projectile has not traveled. The zero distance is the origin of the projectile on the path. As the projectile travels, there may be a slight rise in the projectile due to the angle at which the projectile is released within the angle of movement (FIG. 3, 311). An intentional rise in the projectile may be created, in order to account for the placement of the shooting position (FIG. 3, 309) in relation to the target. The intentional rise may be used to overcome or compensate for the effects of gravitational pull on the projectile. As the distance increases, the projectile may drop due to the effects of the gravitational force on the projectile.

The target generator (100) may consider the effects of the trajectory and drop of the projectile in creating the vital zone target (2300).

Figure 6A:
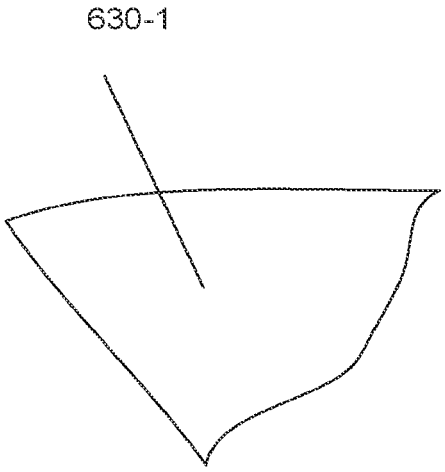
FIGS. 6A-6C illustrate the shape of a vital zone which is rotated as though an animal were standing at a different angle from the marksman.
Figure 6B:
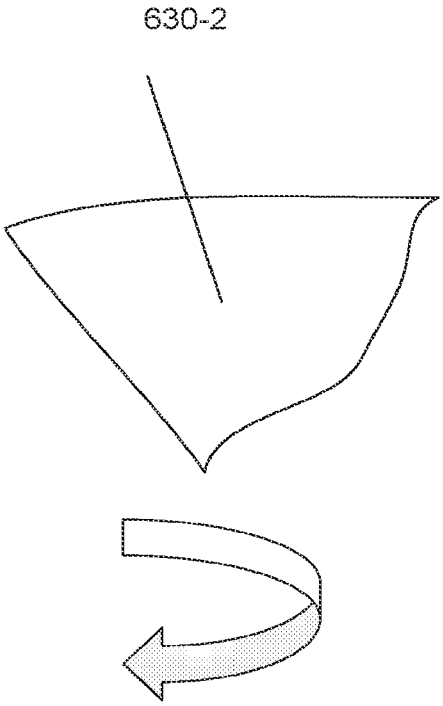
Figure 6C:
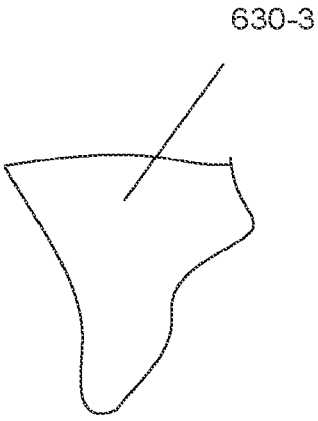

FIGS. 6A-6C represent a vital zone (630) as it may be rotated, based on the presentation of the animal in relationship to the marksman. As illustrated in FIG. 6A represents a broad sideview of the vital zone (630-1). FIG. 6B represents that the vital zone (630-2) is going to be rotated in a counterclockwise rotation on a vertical axis. After a rotation of 90° the vital zone (630-3) may appear as a different shape, as illustrated in FIG. 6C. The vital zone is a three-dimensional area within an animal that may present with a different outline depending on the position of the animal in relationship to the marksman. In illustrating the vital zone target (2300) it may be the outline of the vital zone in the presentation of that vital zone to the marksman.

Figure 7:
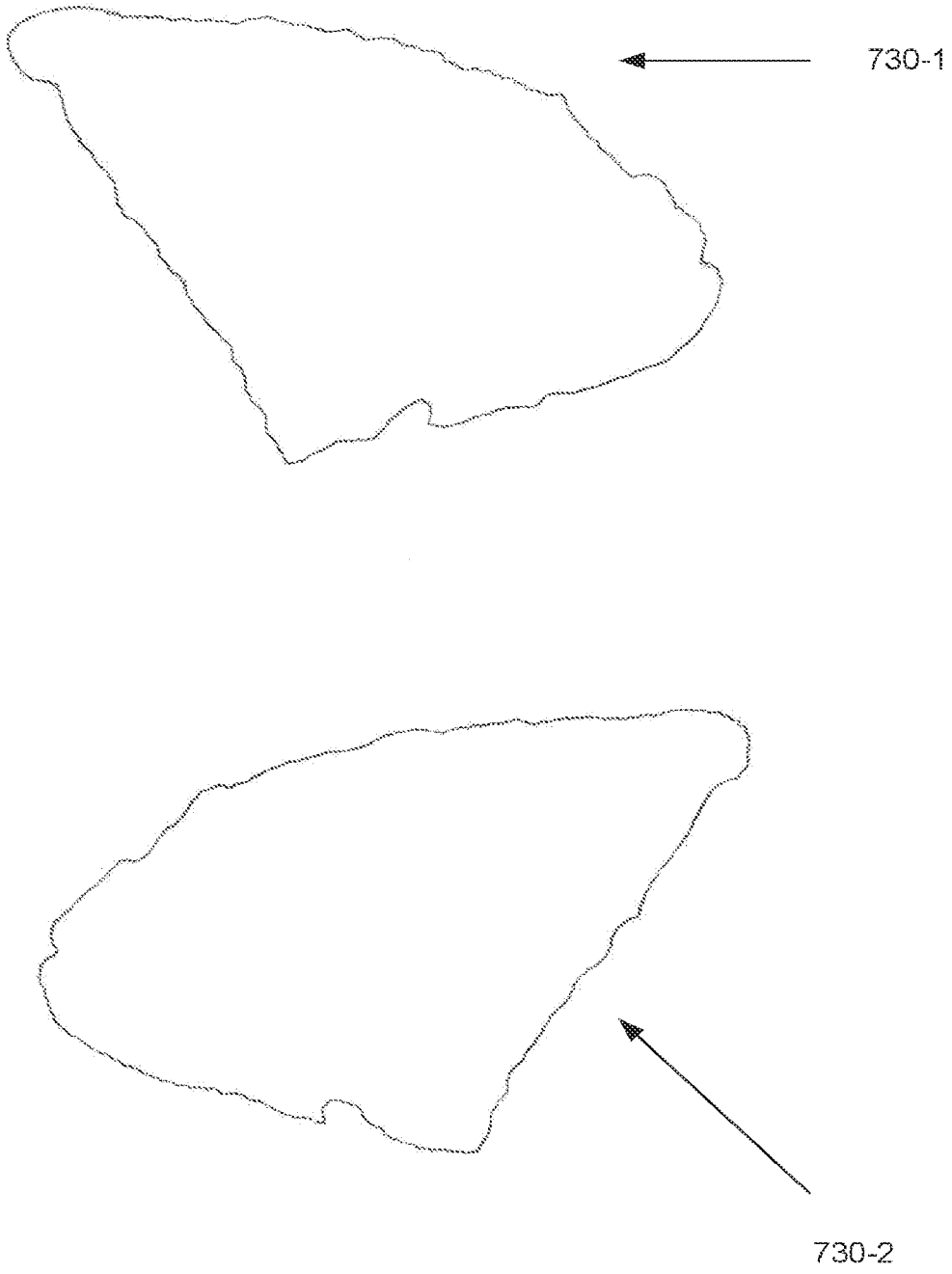
FIG. 7 illustrates a right side and a left side of a vitals target as may be represented by a target generator.

FIG. 7 represents the presentation of the vital zone to a marksman from different angles. In this example, when the animal is facing to the right a first vital zone target (730-1) is presented. When the animal is facing to the left, a second vital zone target (730-2) is presented. Due to the three-dimensional nature of the vital zone, the shape of the vital zone varies depending on the presentation of the animal to the marksman.

Figure 8:
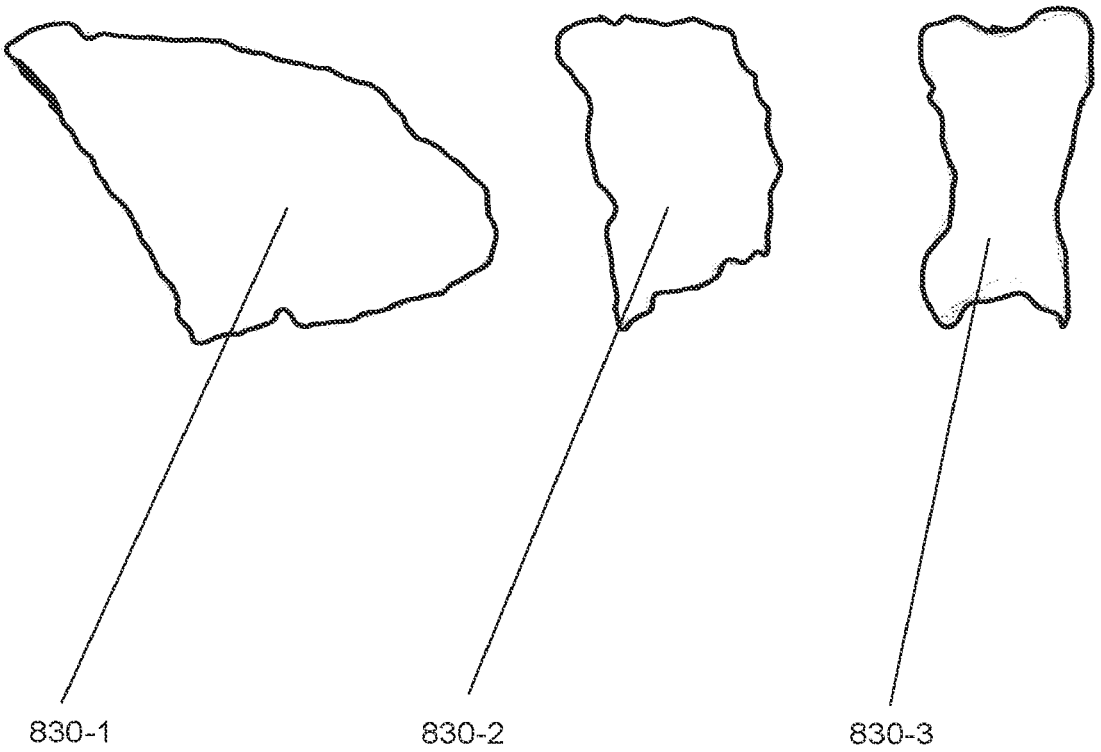
FIG. 8 illustrates the shape of a vitals target from different angles.

FIG. 8 represents an illustration of the vital zone as the presentation of the animal in relationship to the marksman varies. In this example, a first vital zone (830-1) represents a broad side view of the vital zone of the animal in relationship to the marksman. A second vital zone (830-2) represents the outline of the vital zone as the animal is facing at a 45° angle toward the marksman. This shows the variation in the presentation of the vital zone depending on the presentation of the animal. The third vital zone (830-3) represents the presentation of the outline of the vital zone as the animal faces directly at the marksman. Understanding the shape of the vital zone and the ability of the marksman allows the marksman to better demonstrate their skills and to engage in a more ethical hunt, allowing for more humane treatment of the animal during the hunt.

Figure 9:
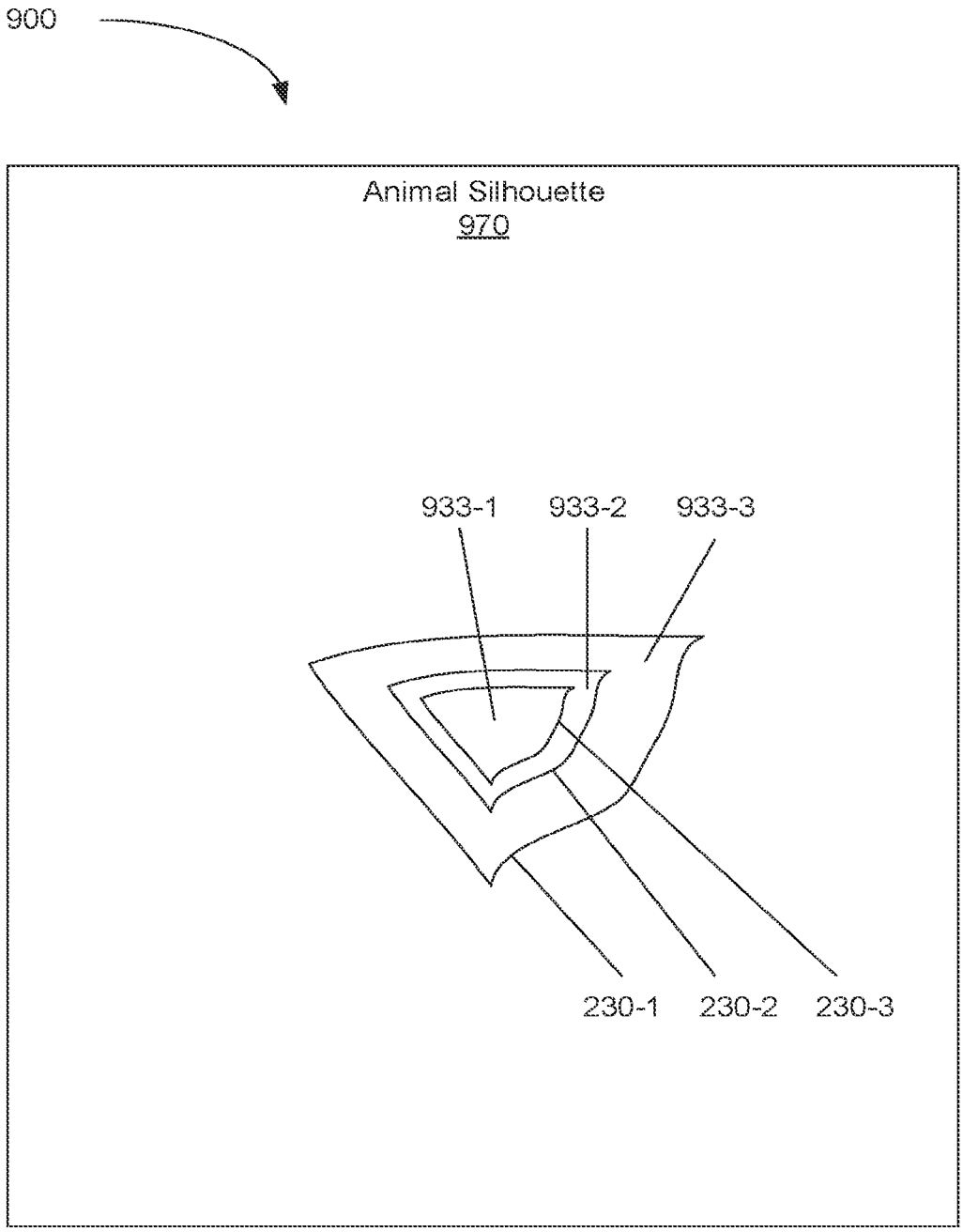
FIG. 9 illustrates an apparatus for training marksmanship according to one example of the principles described herein.

FIG. 9 represents an apparatus (900) for training marksmen. The apparatus includes an animal silhouette (970), a number of vital zones (230), and a number of amulets (933).

The animal silhouette (970) may be used to identify the vital zones (230) of the animal being targeted. The animal silhouette (970) may also illustrate the simulated angle of the animal in relationship to the marksman. The animal silhouette (970) may illustrate the placement of the vital zone (230) in relationship to the animal. The vital zone (230) may be to scale with the animal, or the animal may be at a different scale than the vital zone targets.

The number of amulets (933) may vary in size and area, based on the illustrated distance of the vital zones (230). The amulets (933) may be shaded or colored to illustrate which vital zone is appropriate for which distance.

Figure 10:
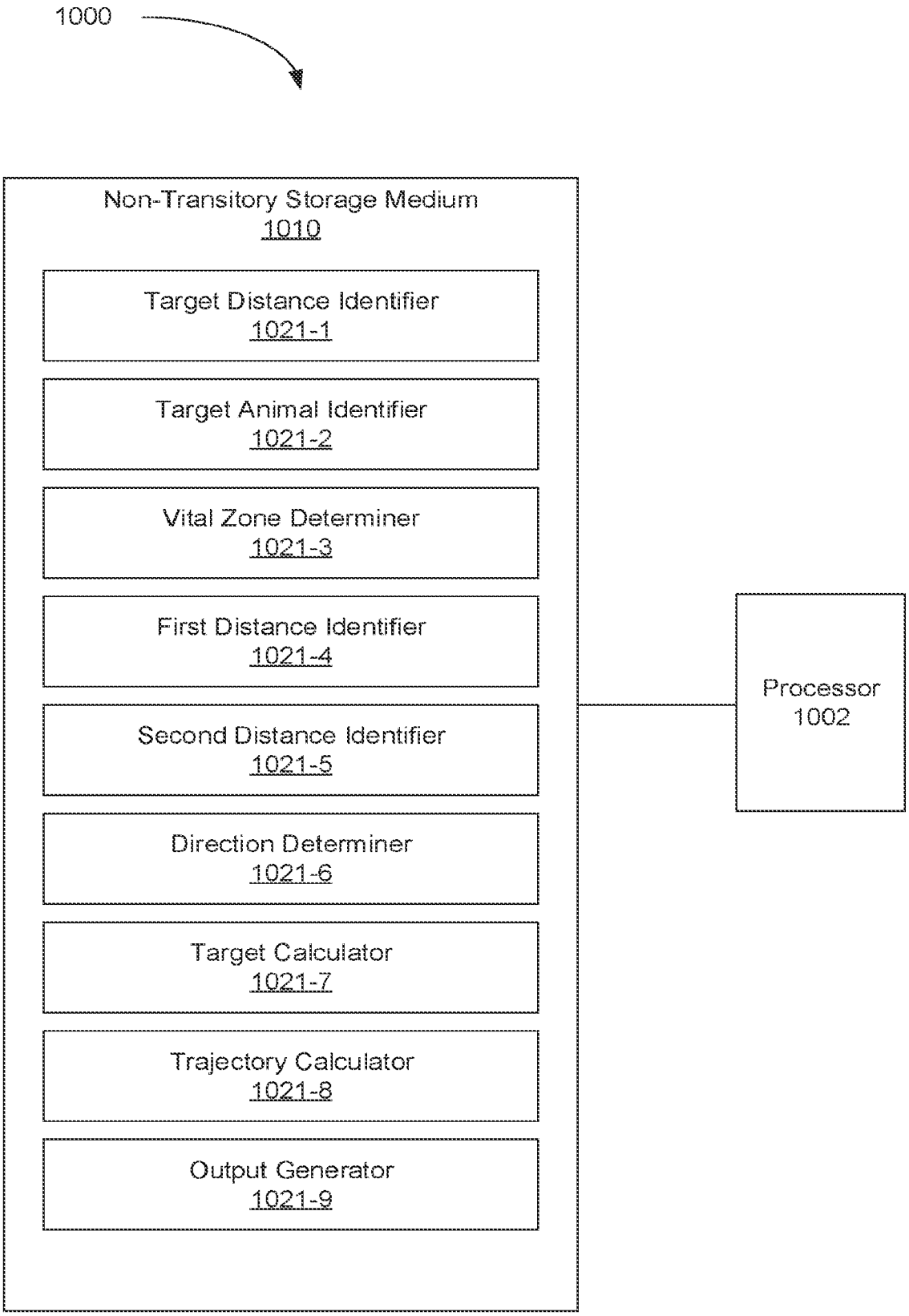
FIG. 10 represents a computer program product for generating vitals targets on a device.

FIG. 10 represents a computer program product (1000) for generating a vitals target (FIG. 2, 230) on a device. The computer program product (1000) includes a non-transitory storage medium (1010). The non-transitory storage medium includes a number of modules that, when executed by a processor (1002), cause a device to perform a particular task.

The non-transitory storage medium (1010) includes a target distance identifier (1021-1), a target animal identifier (1021-2), a vital zone determiner (1021-3), a first distance identifier (1021-4), a second distance identifier (1021-5), a direction determiner (1021-6), a target calculator (1021-7), a trajectory calculator (1021-8), and an output generator (1021-9).

The target distance identifier (1021-1) identifies a distance at which the target may be used at. The target distance will affect the size of the target presented to a user.

The target animal identifier (1021-2) identifies an animal for which a vital zone will be simulated.

The vital zone determiner (1021-3) identifies the three-dimensional attributes of the vital zone of the animal which will be simulated.

The first distance identifier (1021-4) identifies a first distance to be simulated at the target distance for the vital zone of the animal identified.

The second distance identifier (1021-5) identifies a second distance to be simulated at the target distance for the vital zone of the animal identified.

The direction determiner (1021-6) identifies the direction of the animal identified in relationship to the marksman that will be using the target. For example, the direction determiner (1021-6) may identify the animal as looking to the left, right, at a 45° angle, or straight at the marksman.

The target calculator (1021-7) calculates the shape of the vital zone at the angle determined for the animal identified at the distance simulated for the target distance.

The trajectory calculator (1021-8) may calculate the trajectory of a projectile to determine the placement of a number of vital zone targets.

The output generator (1021-9) causes the device to generate a vitals target. The output generator may generate a vitals target with a plurality of vital zones. The vital zones may have a plurality of different center points based on a trajectory calculation by the trajectory calculator (1021-8). The output generator may generate an overlay image of the animal corresponding to the vitals target. The overlay image may be used to identify the vitals target.

Figure 11:
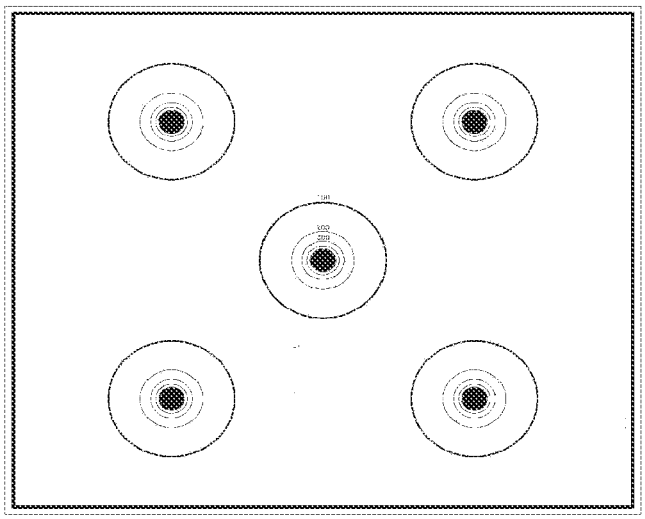
FIG. 11 illustrates a number of targets with a plurality of vital zones for different distances, according to one example of the principals described herein.

FIG. 11 represents a number of targets according to one example of the principals described herein. As illustrated, the target contains a number of individual targets. In this example, the target is configured for 75 feet, but includes vital zone indicators for 100, 200, 300, 400, 500, and 600 yards.

Figure 12:
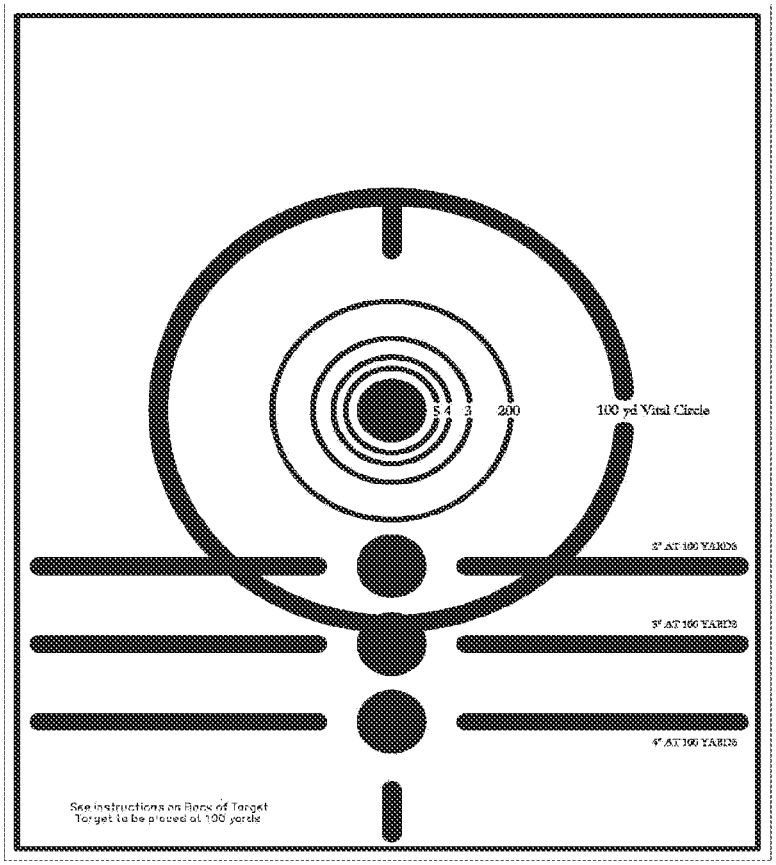
FIG. 12 illustrates a target with a plurality of vital zones for different distances according to one example of the principles described herein.

FIG. 12 represents a target according to one example of the principals described herein. In this example, the target is configured to be displayed at 100 yards. The target includes secondary targets to account for the trajectory of the projectile. Due to the gravitational effect on the projectile the marksmen may configure a rifle to strike the target high. In this example, secondary bullseyes are labelled for 2, 3 and 4 inches below where the projectile is expected to strike.

Figure 13:
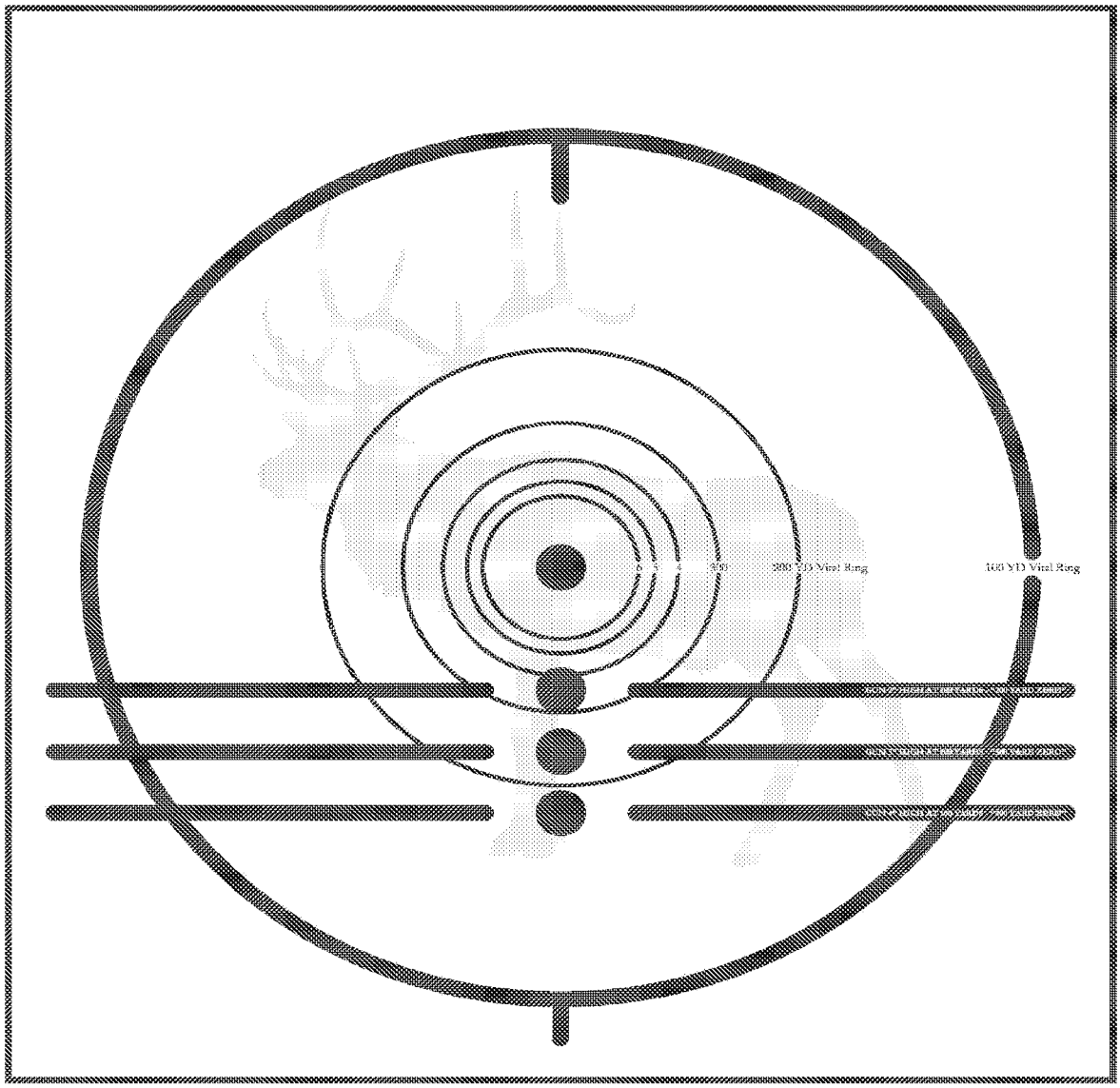
FIGS. 13-16 represent a number of vital zone targets with identifying animals, according to one example of the principles described herein.

FIG. 13 represents a target of an elk according to one example of the principals described herein. In this example, the vital zone is sized for an elk and set to be used at 100 yards. The vital zone is then adjusted to simulate 200, 300, 400, 500, and 600 yards. Additionally, secondary bullseyes are placed to account for the arch of the flight pattern of the projectile. The marksmen can adjust where the projectile strikes on the target by using an alternative bullseye.

Figure 14:
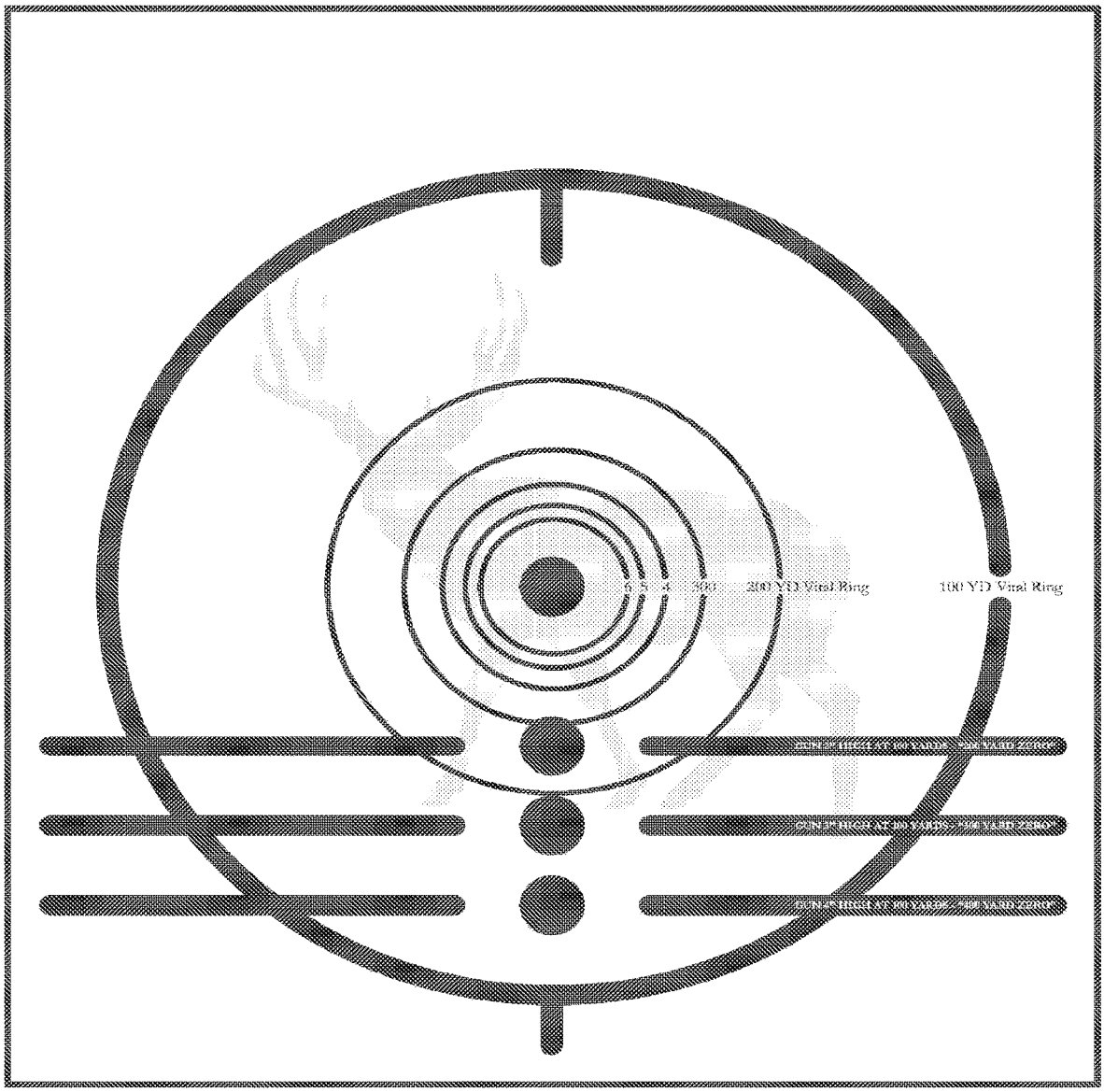

FIG. 14 represents a target of a mule deer according to one example of the principals described herein. In this example, the vital zone is sized for a mule deer and set to be used at 100 yards. The vital zone is then adjusted to simulate 200, 300, 400, 500, and 600 yards. Additionally, secondary bullseyes are placed to account for the arch of the flight pattern of the projectile. The marksmen can adjust where the projectile strikes on the target by using an alternative bullseye.

Figure 15:
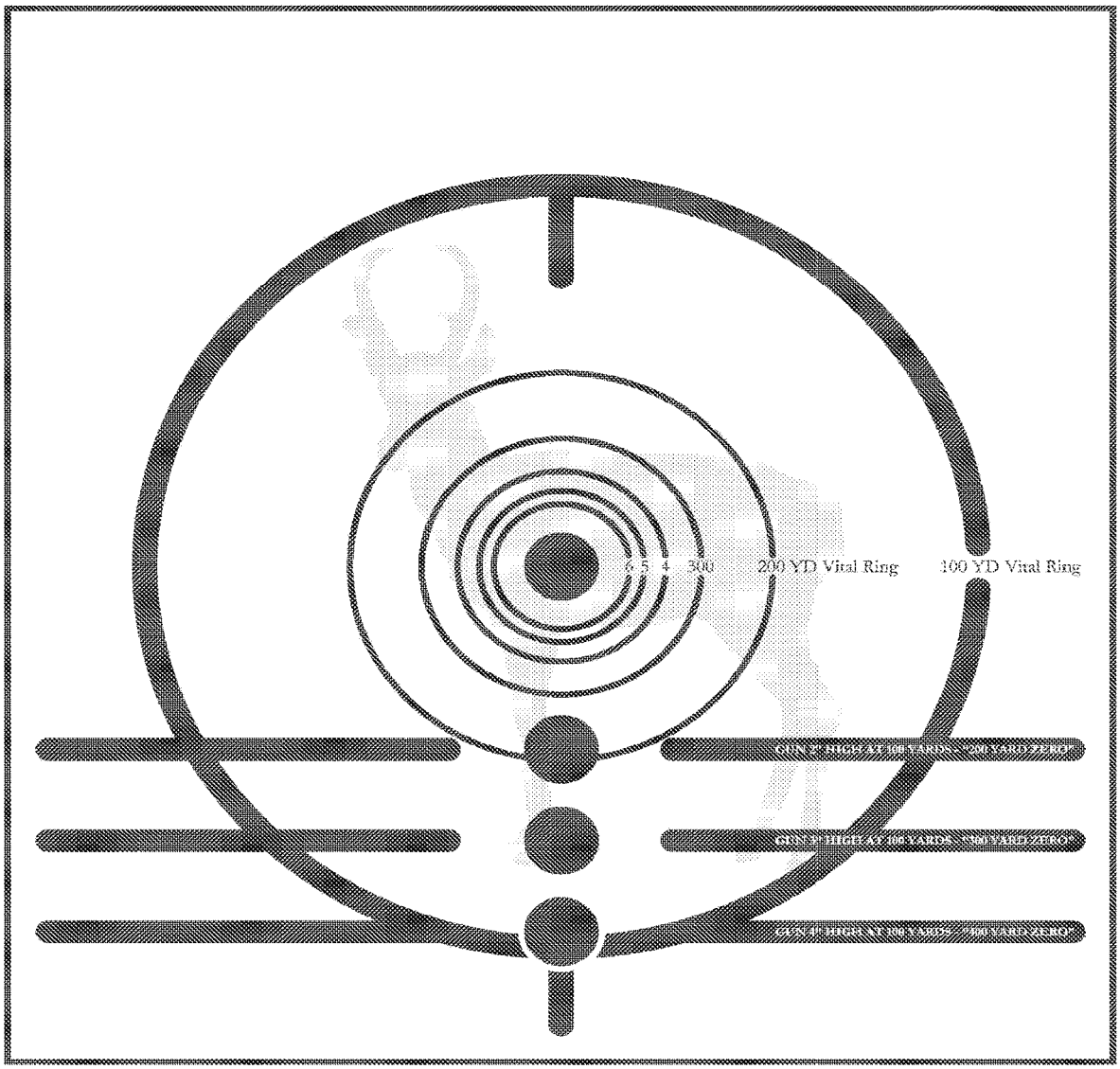

FIG. 15 represents a target of a pronghorn according to one example of the principals described herein. In this example, the vital zone is sized for a pronghorn and set to be used at 100 yards. The vital zone is then adjusted to simulate 200, 300, 400, 500, and 600 yards. Additionally, secondary bullseyes are placed to account for the arch of the flight pattern of the projectile. The marksmen can adjust where the projectile strikes on the target by using an alternative bullseye.

Figure 16:
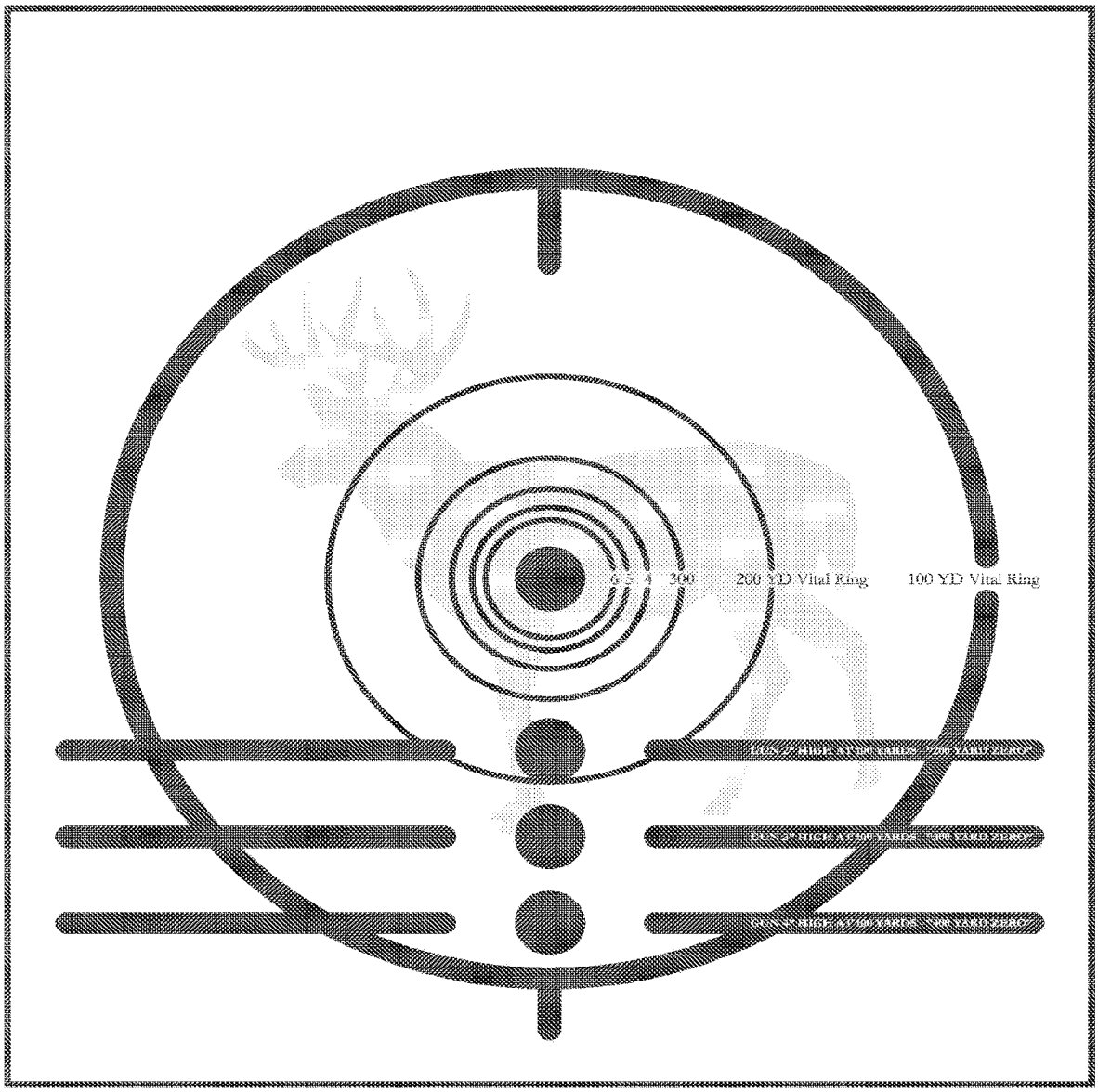

FIG. 16 represents a target of a whitetail deer according to one example of the principals described herein. In this example, the vital zone is sized for a white tail and set to be used at 100 yards. The vital zone is then adjusted to simulate 200, 300, 400, 500, and 600 yards. Additionally, secondary bullseyes are placed to account for the arch of the flight pattern of the projectile. The marksmen can adjust where the projectile strikes on the target by using an alternative bullseye.

Figure 17:
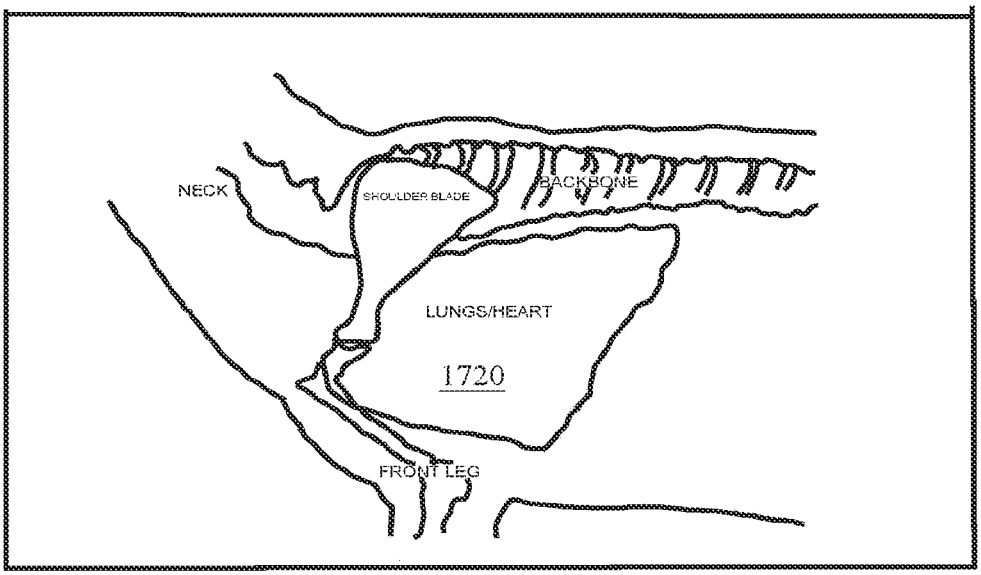
FIG. 17 represents a vital zone target according to one example of the principles described herein.

FIG. 17 represents a vitals target of an animal. The vital zone (1720) represent the vital zone of an animal. Vital zones indicate the location of vital organs, such as the heart, lungs, or brain.

Figure 18:
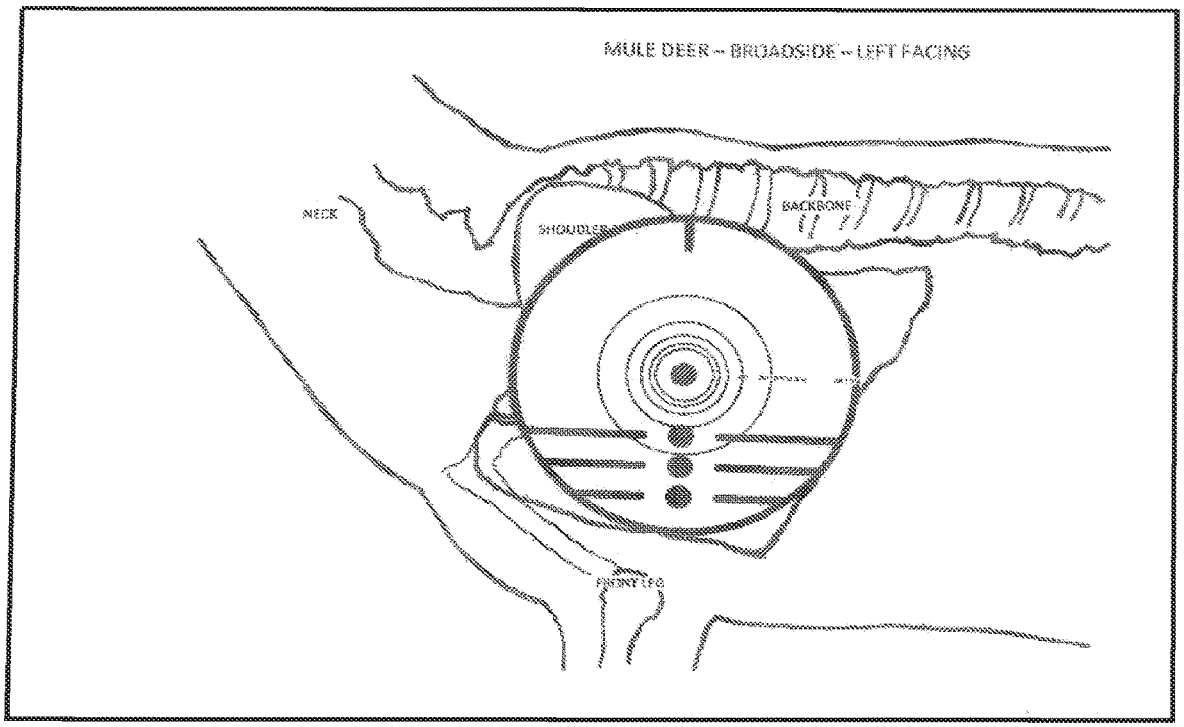
FIG. 18 represents a number of vital zone targets with identifying animals, according to one example of the principles described herein.

FIG. 18 represents a vitals target used to approximate the vital organs of animal. The vitals target (1821) indicates that shot placement that is most likely to indicate an ethical hunt. The vitals target (1821) may include representations of a plurality of vital zones for a plurality of distances.

FIG. 19A represents various Western game, the vital size of the game, and the diameter of a ring which may be used to simulate shooting from a certain distance, such as 200 yd. FIG. 19B represents the data for African game. FIG. 19C represents vital area by animal.

FIG. 20 represents a chart of vital size and yardage adjustments. It shows some vital sizes as measured in inches and shows the diameter of a ring that may be representative of the vital size at a certain simulated shooting distance with the target being set at a prescribed distance.

FIG. 21 represents possible angle calculations. A shooter may want to simulate shooting from a different distance than 100 yards, such as 200 yards. The target then may be calculated for the outer ring to be the vital size at 200 yards using the Angle Subtended and confirmed with a 200 yard MOA calculation. The target would then have a second ring, which may be a ring that has a diameter smaller than the diameter of the outer ring but larger than any other ring on the target, other than the outer ring. The diameter of the second ring may be calculated by determining a division factor, which is the number by which the shooting distance associated with the diameter of the outer ring, such as 200 yards, may be divided by to determine the shooting distance associated with the second ring diameters of the second ring. The diameter of the second ring may then be determined by dividing the diameter of the outer ring by the division factor.

A shooter may want to simulate shooting from a determined distance and have the target circles represent the size of the vitals at the shooting distance determined for a set further distance for multiple animals. An example would be a target set at 100 yards with the circles representing the size of vitals at 200 yards. Each animal vital circle would be used starting with the largest vital circle to the smallest. The sizes of these vital circles are determined by Angle Subtended and 1/n formulas. Representative data is illustrated in FIG. 20.

In the preferred embodiments when the outer ring is 10 inches and the outer ring corresponds with a 100-yard distance, then a division factor of 2 may be used for a second ring that may be associated with a 200 yard simulated shooting distance since 200 yards divided by 100 yards equals 2. Then, dividing the actual distance of the diameter of the outer ring by the multiplication factor of 2 may be calculated as follows: 10 inches/2=5 inches in diameter for the second ring. Other simulated distances may be used, and other diameters of associated rings may be used. Additionally, the diameter of the associated ring may also undergo a correction adjustment, such as being divided by 1.047, or multiplied by 0.95493. All references may be calculated using an angle subtended, such as with the following formula: diameter=2 arctan r/R. One may then convert to radians, degrees, or arcs. Thus, in the preferred embodiments, when a vital area of an animal is determined to be 10 inches, such as 10 inches, at a 100 yard simulated shooting distances, then the 10 inches may be divided by 1.047 (multiplied by 0.95493) for the actual diameter of the outer ring. The second ring may then be associated with a simulated shooting distance of 200 yard, the division factor would then be 2, and the diameter of the second ring would then be the adjusted size of 10 inches×0.95493 divided by 2.

The third ring may then be associated with a simulated shooting distance of 300 yard, the division factor would then be 3, and the diameter of the third ring may then be 10 inches/1.047/3. (10*0.95493/3). The 10 inches could be any length that is associated with the vital area of an animal that may be hunted legally or illegally by humans.

The fourth ring may then be associated with a simulated shooting distance of 400 yard, the division factor would then be 4, and the diameter of the second ring would then be 10 inches/1.047/4. (10*0.95493/4).

The fifth ring may then be associated with a simulated shooting distance of 500 yard, the division factor would then be 5, and the diameter of the second ring would then be 10 inches/1.047/5. (10*0.95493/5).

The sixth ring may then be associated with a simulated shooting distance of 600 yard, the division factor may then be 6, and the diameter of the second ring may then be 10 inches/1.047/6. (10*0.95493/6).

The reduction in size of a vital area by 1/1.047 may be determined by a bullet spread calculation. With the bullet spread calculation, one may determine the angle at 100 yards that one must shoot at to shoot a bullet within one of the rings and how this angle relates to the vital size of an animal at distances longer than 100. Using a measure of angle, the targets may be configured for bullet spread grouping. The bullet spread calculation using MOA at one hundred yards mathematically may match the Angle Subtended calculation and both follow the 11/N formula for the concentric rings. The bullet spread calculation sheet may allow one that is focused on MOA to confirm that the target circles are giving them the same results. See FIG. 22.

A bullet spread calculation may use 1 MOA at 100 yards to confirm 100 yard target size then extrapolate the spread as yardage increases. This spread number may be compared to 100 yard target size. A shooter may then shoot a series of bullets at the target, such as 5 bullets. The shooter may then count the hit number, the hit number being the number of bullets that contact the target within a certain ring; the shooter may then compare that hit number to threshold data in a bullet spread column; when a hit number is equal or greater than the corresponding threshold data, a shooter may then confirm his or her ethical shooting range.

With the bullet spread calculation, one may determine the angle at 100 yards that one must shoot at to shoot a bullet within one of the rings and how this angle relates to the vital size of an animal at distances longer than 100.

In some embodiments the target has a bullet grouping not only defined by the largest distance between where the bullet hits on the target but also the largest difference from a bullseye to the furthest bullet hole. This measurement may be used when calculating bullet spread. See FIG. 22 for a sample bullet spread that may be included with a target kit.

In some embodiments, the concentric vital circles may be determined by Measurement of Angle bullet spread.

FIG. 22 represents a bullet spread/grouping chart showing one possible correlation between shooting a specific size grouping at 100 yards and how the diameter of that size grouping increases as the shooter's distance from the target increase or as the simulated distance from the target increases. Simulated distance may be determined by an inverse correlation such that a decrease in the size of a ring is represented in an increase in the simulated distance. Simulated distance represents a distance, associated with a vital size diameter, that one would need to stand from the target to have a substantially similar experience as if one actually positioned one's self the simulated distance from the target and shot at a ring having the corrected diameter representing the size of a vital area for an animal. In other words, shooting at a ring that is substantially ⅓ in diameter of the outer ring simulates shooting at 300 yards because the shooting distance has been tripled, with a simulated distance of 300 yards is simulated distance the diameter of the outer ring, Thus, using the disclosed target, a hunter may then simulated shooting at a 10 inch/1.047 vital area for a specific type of game animal. For example, a 10 inch vital area at 100 yards may be correlated with a 5 inch vital area, that is ½ of the 10 inch vital area, which simulates a shooter distance of 2*100 yards. After calculation of the bullet spread numbers, the dimensions of the rings on the targets may be determined. FIG. 22 illustrates how bullet groups may spread as the distance from the target or the simulated distance from the target is increased. Additionally, one may use another method to determine how your group limits your yardage in relationship to vital size areas by animal. FIG. 4 may be used to determine the bullet groupings and bullet spreads for a given yardage or simulated yardage when the actual vital size of an animal is known. A shooter or hunter may use FIG. 22 to determine one's ethical shooting range.

Figure 23:
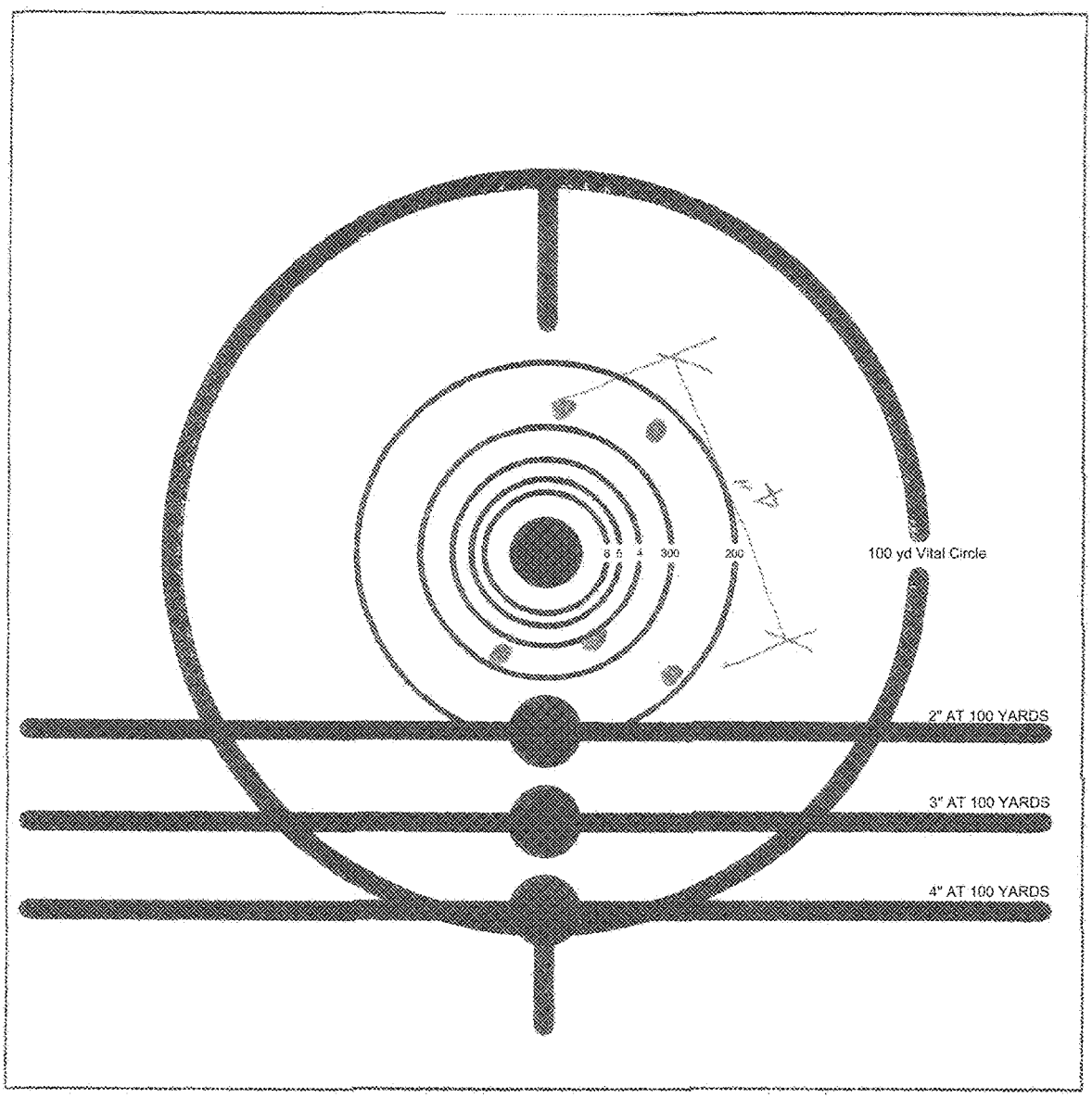
FIG. 23 illustrates a schematic of a target.

FIG. 23 represents a reduced size version of the Antelope/Pronghorn target with the contact area of 5 shots. From these, the maximum distance apart is 4 inches. On the target, the largest ring that any bullet hit is the 200 yard circle. Thus, the target shows that this target represents the shooters ethical effective range to be 200 yards. The bullet spread calculations may then be used. The 4 inch grouping is the fourth column, going down this column you find the bullet spread at 200 yards to be 8.38 inches. Using the Western Game vital sheet you find that Antelope/Pronghorn has a vital size of 9" and adjusted size of 8.595 inches at 100 yards. Since 8.595 inches is larger than the 8.38 inches so the bullet spread confirms this shooter's ethical effective range is 200 yards. Note the 300 yard bullet spread in the fourth column is 12.56". This now is larger than the vital size of 8.595 so the shooter knows to not take a shot at this range if the shooter wants to stay within the shooter's ethical and effective range.

In some embodiments the target may have horizontal lines with markers centered along the horizontal lines; the horizontal lines may be used as a reference point for someone aiming at the target.

The foregoing descriptions of embodiments have been presented only for purposes of illustration and description. They are not intended to be exhaustive or to limit the embodiments to the forms disclosed. Accordingly, many modifications and variations will be apparent to practitioners skilled in the art. Additionally, the above disclosure is not intended to limit the embodiments. The scope of the embodiments is defined by the appended claims.

I claim:

1. A method for determining a shooter's shot accuracy for an ethical shot at a target item, comprising:

positioning at a selected distance from a shooting location a vitals target apparatus for measuring a shooter's shot accuracy, wherein the vitals target apparatus comprises:

a plurality of concentric vital zones, each vital zone indicating a vital area of the target item to strike for a shot at up to a specified shot distance, wherein the plurality of concentric vital zones having a center aiming portion; and a plurality of amulets, the amulets being an area between two vital zone outlines, the amulets representing a difference in grouping size of a plurality of shots corresponding to the shot at different shot distances, wherein a first amulet corresponds to a first shot distance and a second amulet corresponds to a second shot distance different than the first shot distance; shooting by the shooter a number of shots from the shooting location and at the center aiming portion of the vitals target apparatus;

identify shot impact locations of each of the number of shots from the shooting location on the vitals target apparatus relative to the plurality of concentric vital zones and the plurality of amulets;

determining the smallest amulet within which all of the shot impact locations are grouped; and determining the maximum distance at which the shooter can reliably strike the target item in the vital area with the shot based on the smallest amulet within which all of the shot impact locations are grouped, wherein the smallest amulet is correlated to the shot at a designated shot distance and correlated to the vital area of the target item at that designated shot distance.

2. The method of claim 1, further comprising using the maximum distance information to determine whether a shooter can reliably strike the target item in the vital area.

3. The method of claim 1, further comprising determining shot spread information corresponding to the greatest distance between shot impact locations within the group of shot impact locations on the vitals target apparatus.

4. The method of claim 2, further comprising using the shot spread information in determining the maximum distance at which the shooter can reliably strike the target item in the vital area.

5. The method of claim 1, wherein positioning the vitals target apparatus comprises positioning the vitals target apparatus at a measuring shot distance from the shooting location and each of the vital zone areas on the vitals target apparatus are sized based on the measuring shot distance between the shooting location and the position of the vitals target apparatus.

6. The method of claim 5 wherein positioning the vitals target apparatus at the measuring shot distance from the shooting location comprises positioning the vitals target apparatus at the measuring shot distance of approximately 50 yards.

7. The method of claim 5 wherein positioning the vitals target apparatus at the measuring shot distance from the shooting location comprises positioning the vitals target apparatus at the measuring shot distance of approximately 100 yards.

8. The method of claim 1, wherein firing by the shooter a number of shots comprises the shooter firing five shots from the shooting location at the center aiming portion of the vitals target apparatus.

9. The method of claim 1, wherein a size of each vital zone area is based on a corresponding maximum shooting distance, a diameter of the vital zone area, and a subtended angle correction factor.

10. The method of claim 1, wherein shooting by the number of shots from the shooting location comprising shooting projectiles fired from a firearm, an air gun, or a bow.

11. The method of claim 1, wherein plurality of vital zones are sized based on the relative size of a vital organ zone of an animal.

12. The method of claim 1, wherein the numbers of shots is a plurality of a number of shots comprising a first number of shots and a second number of shots, and wherein the method further comprises:

firing the first number of shots at a first vitals target apparatus to collect first shot positioning information, firing the second number of shots at a second vitals target apparatus to collect second shot positioning information, and comparing the first shot positioning information and the second shot positioning information to determine varying accuracies of the shooter.

13. A method for determining a shooter's shot accuracy for an ethical shot at a target item, comprising:

positioning at a measuring shot distance from a shooting location a vitals target apparatus for measuring a shooter's shot accuracy, wherein the vitals target apparatus comprises:

a plurality of vital zones, wherein the vital zones are shaped and sized based on the measuring shot distance and relative sizes of a vital zone of a target item at a plurality of shooting distances different than the measuring shot distance;

wherein a first vital zone corresponds to a first relative vital zone size of the target item at a first shooting distance and a second vital zone corresponds to a second relative vital zone size of the target item at a second shooting distance greater than the first shooting distance;

wherein the area of the first vital zone is larger than the area of the second vital zone; and firing by the shooter a number of shots from the shooting location and at a center aiming portion of the vitals target apparatus;

identify shot impact locations of each of the number of shots from the shooting location on the vitals target apparatus relative to the plurality of vital zones;

determining the smallest vital zone within which all of the shot impact locations are grouped;

determining based on the smallest vital zone within which all of the shot impact locations are grouped maximum distance information corresponding to a maximum distance at which the shooter can reliably strike the target item in the vital zone with the shot;

using the maximum distance information to determine whether a shooter can reliably strike the target item in the vital area.

14. The method of claim 13, further comprising determining shot spread information corresponding to the greatest distance between shot impact locations within the group of shot impact locations on the on the vitals target apparatus.

15. The method of claim 14, further comprising using the shot spread information in determining the maximum distance at which the shooter can reliably strike the target item in the vital area.

16. The method of claim 13, further comprising determining a largest distance from the center aiming portion to any of the shot impact locations on the vitals target apparatus.

17. The method of claim 13, wherein positioning the vitals target apparatus at a measuring shot distance of approximately 50 yards or 100 yards and each of the vital zones on the vitals target apparatus are sized based on the measuring shot distance between the shooting location and the position of the vitals target apparatus.

18. The method of claim 13, wherein the vitals target apparatus has a plurality of sighting features within or adjacent to the vital zones and positioned relative to the vital zone for use in aiming at the plurality of vital zones, and wherein firing by the shooter a number of shots includes aiming for the center aiming portion using the plurality of sighting features for the aiming.

19. The method of claim 13, wherein firing by the shooter a number of shots comprises the shooter firing five shots from the shooting location at the center aiming portion of the vitals target apparatus.

20. The method of claim 13, wherein shooting by the number of shots from the shooting location comprising shooting projectiles fired from a firearm, an air gun, or a bow.

21. A method for determining whether a user's firing range is likely to result in an ethical shot comprising:

positioning a vitals target apparatus having:

a plurality of vital zones, each vital zone indicating a vital zone of a target item to strike for a humane hunt at a specified distance;

a number of amulets, the amulets being an area between two vital zone outlines, the amulets representing a difference in grouping size used for a humane hunt at a plurality of different distances and measuring a skill of a marksmen; and a plurality of bullseyes, the bullseyes providing compensation for a trajectory of a projectile at an alternative distance;

firing a number of shots at the vitals target apparatus to collect shot positioning information for each round; and using the shot positioning information to determine if a proposed shot is within an ethical range for the user to fire at the target item.

* * * * *